US009061426B2

(12) United States Patent
Harvey

(10) Patent No.: US 9,061,426 B2
(45) Date of Patent: Jun. 23, 2015

(54) KNIFE

(71) Applicant: Milwaukee Electric Tool Corporation, Brookfield, WI (US)

(72) Inventor: Kyle Harvey, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/912,129

(22) Filed: Jun. 6, 2013

(65) Prior Publication Data

US 2013/0326884 A1 Dec. 12, 2013

Related U.S. Application Data

(60) Provisional application No. 61/656,181, filed on Jun. 6, 2012, provisional application No. 61/680,398, filed on Aug. 7, 2012.

(51) Int. Cl.
*B26B 1/04* (2006.01)
*B26B 11/00* (2006.01)

(52) U.S. Cl.
CPC ..... *B26B 1/042* (2013.01); *B26B 1/044* (2013.01); *B26B 1/046* (2013.01); *B26B 11/006* (2013.01)

(58) Field of Classification Search
CPC ..... B26B 1/02; B26B 1/04; B26B 1/042; B26B 1/044; B26B 1/046; B26B 1/048
USPC ..... 30/153–161
See application file for complete search history.

(56) References Cited

U.S. PATENT DOCUMENTS

| | | | |
|---|---|---|---|
| 23,975 | A | 5/1859 | Belcher |
| 226,910 | A | 4/1880 | Friebertshauser |
| 273,858 | A | 3/1883 | Korn |
| 462,141 | A | 10/1891 | Kruschke |
| 470,605 | A | 3/1892 | Schrade |
| 476,245 | A | 6/1892 | Bultzingslowen |
| 492,620 | A | 2/1893 | Balston |

(Continued)

FOREIGN PATENT DOCUMENTS

| | | | | |
|---|---|---|---|---|
| FR | 352005 | A | * | 8/1905 |
| JP | 07144072 | A | * | 6/1995 |
| WO | WO 2013184974 | A2 | * | 12/2013 |

OTHER PUBLICATIONS

International Search Report and Written Opinion for Application No. PCT/US2013/044612 dated Feb. 14, 2014 (9 pages).

*Primary Examiner* — Jason Daniel Prone
(74) *Attorney, Agent, or Firm* — Michael Best & Friedrich LLP

(57) ABSTRACT

A knife including a handle, a blade, and a frame at least partially within the handle, the frame including a first locking member and a second locking member, the first locking member is at least partially formed from a leaf spring portion of the frame, the second locking member is at least partially formed from a second leaf spring portion of the frame. The second locking member engages the blade to retain the blade in a retracted position and the second locking member is movable out of engagement with the blade to allow movement of the blade from the retracted position to an extended position. The first locking member engages the blade to retain the blade in the extended position and the first locking member is movable out of engagement with the blade to allow movement of the blade from the extended position to the retracted position.

13 Claims, 25 Drawing Sheets

(56) References Cited

U.S. PATENT DOCUMENTS

| | | | | |
|---|---|---|---|---|
| 530,788 | A | 12/1894 | Moritz | |
| 551,052 | A | 12/1895 | Shonnard et al. | |
| 553,430 | A | 1/1896 | Schmachtenberg | |
| 592,612 | A | 10/1897 | Johnson | |
| 730,025 | A | 6/1903 | Kaufmann | |
| 812,601 | A | 2/1906 | Schrade | |
| 845,130 | A | 2/1907 | Schrade | |
| 1,030,058 | A | 6/1912 | Doles | |
| 1,512,689 | A * | 10/1924 | Hermann | 30/161 |
| 1,584,165 | A | 5/1926 | Brown | |
| 1,810,031 | A | 6/1931 | Schrade | |
| 2,183,378 | A | 12/1939 | Conklin | |
| 2,197,136 | A | 4/1940 | Share et al. | |
| 2,199,430 | A | 5/1940 | Greve | |
| 2,188,762 | A | 6/1940 | Schrade | |
| 2,261,267 | A | 11/1941 | Metz | |
| 2,263,415 | A | 11/1941 | Berg et al. | |
| 2,304,601 | A | 12/1942 | Schrade | |
| 2,407,897 | A | 9/1946 | Newman | |
| 2,530,236 | A | 11/1950 | Erickson | |
| 3,868,774 | A | 3/1975 | Miori | |
| 4,347,665 | A | 9/1982 | Glesser | |
| 4,451,982 | A | 6/1984 | Collins | |
| 4,719,700 | A | 1/1988 | Taylor, Jr. | |
| 4,730,394 | A | 3/1988 | Sonner, Jr. | |
| 4,773,159 | A | 9/1988 | Casazza, Jr. | |
| 4,811,486 | A | 3/1989 | Cunningham | |
| 4,858,320 | A | 8/1989 | Lemaire | |
| 4,893,409 | A | 1/1990 | Poehlmann | |
| 4,901,439 | A | 2/1990 | Boyd, Jr. | |
| 4,947,552 | A * | 8/1990 | Barnes | 30/161 |
| 5,029,354 | A | 7/1991 | Boyd, Jr. et al. | |
| 5,095,624 | A | 3/1992 | Ennis | |
| 5,111,581 | A | 5/1992 | Collins | |
| 5,325,588 | A | 7/1994 | Rogers | |
| 5,425,175 | A | 6/1995 | Rogers | |
| 5,438,757 | A | 8/1995 | Weschenfelder | |
| 5,485,677 | A | 1/1996 | Seber | |
| 5,495,674 | A | 3/1996 | Taylor, Jr. | |
| 5,501,015 | A | 3/1996 | Harvey | |
| 5,502,895 | A | 4/1996 | Lemaire | |
| 5,511,310 | A | 4/1996 | Sessions et al. | |
| 5,528,831 | A | 6/1996 | Fortenberry | |
| 5,537,750 | A | 7/1996 | Seber et al. | |
| 5,546,662 | A | 8/1996 | Seber et al. | |
| 5,572,793 | A | 11/1996 | Collins et al. | |
| 5,596,808 | A | 1/1997 | Lake et al. | |
| 5,615,484 | A | 4/1997 | Pittman | |
| 5,621,973 | A | 4/1997 | Seber et al. | |
| 5,704,129 | A | 1/1998 | Glesser | |
| D392,016 | S | 3/1998 | Balolia | |
| 5,722,168 | A | 3/1998 | Huang | |
| 5,737,841 | A | 4/1998 | McHenry et al. | |
| 5,794,346 | A | 8/1998 | Seber et al. | |
| 5,802,722 | A | 9/1998 | Maxey et al. | |
| 5,815,927 | A | 10/1998 | Collins | |
| 5,819,414 | A | 10/1998 | Marifone | |
| 5,826,340 | A | 10/1998 | Hull | |
| 5,875,552 | A * | 3/1999 | Chen | 30/161 |
| 5,964,036 | A | 10/1999 | Centofante | |
| 5,966,816 | A * | 10/1999 | Roberson | 30/161 |
| D422,872 | S | 4/2000 | Thiebold | |
| 6,079,106 | A | 6/2000 | Vallotton | |
| 6,101,723 | A * | 8/2000 | Ford | 30/161 |
| 6,101,724 | A | 8/2000 | Halligan | |
| 6,122,829 | A | 9/2000 | McHenry et al. | |
| 6,145,202 | A | 11/2000 | Onion | |
| D441,827 | S | 5/2001 | Frank | |
| D442,459 | S | 5/2001 | Wilkinson | |
| 6,256,888 | B1 | 7/2001 | Shuen | |
| D446,571 | S | 8/2001 | Frazer | |
| 6,276,063 | B1 | 8/2001 | Chen | |
| 6,289,592 | B1 * | 9/2001 | Emerson | 30/161 |
| 6,305,085 | B1 | 10/2001 | Stallegger et al. | |
| 6,308,420 | B1 | 10/2001 | Moser | |
| 6,338,431 | B1 | 1/2002 | Onion | |
| D454,611 | S | 3/2002 | Veltz et al. | |
| 6,360,443 | B1 | 3/2002 | Remus | |
| 6,363,615 | B1 | 4/2002 | Moser | |
| 6,378,214 | B1 | 4/2002 | Onion | |
| 6,397,476 | B1 | 6/2002 | Onion | |
| 6,427,334 | B2 | 8/2002 | Onion | |
| 6,427,335 | B1 | 8/2002 | Ralph | |
| 6,430,816 | B2 | 8/2002 | Neveux | |
| 6,434,831 | B2 | 8/2002 | Chen | |
| 6,438,848 | B1 | 8/2002 | McHenry et al. | |
| 6,490,797 | B1 * | 12/2002 | Lake et al. | 30/161 |
| D473,911 | S | 4/2003 | Green | |
| 6,553,671 | B2 | 4/2003 | Blanchard | |
| 6,574,869 | B1 | 6/2003 | McHenry et al. | |
| 6,591,504 | B2 | 7/2003 | Onion | |
| 6,598,297 | B1 | 7/2003 | Matt | |
| D478,957 | S | 8/2003 | Rae et al. | |
| 6,651,344 | B2 * | 11/2003 | Cheng | 30/160 |
| 6,658,743 | B2 * | 12/2003 | Dudley et al. | 30/353 |
| 6,675,484 | B2 * | 1/2004 | McHenry et al. | 30/161 |
| 6,688,407 | B2 | 2/2004 | Etter et al. | |
| 6,729,029 | B1 | 5/2004 | Chu | |
| 6,732,436 | B2 | 5/2004 | Moizis | |
| 6,751,868 | B2 | 6/2004 | Glesser | |
| 6,763,592 | B2 | 7/2004 | Yu | |
| 6,810,588 | B1 | 11/2004 | Cheng | |
| 6,826,836 | B1 | 12/2004 | Lin | |
| 6,834,432 | B1 | 12/2004 | Taylor, Jr. | |
| D502,526 | S | 3/2005 | Rae | |
| 6,895,674 | B2 | 5/2005 | Ai | |
| 6,941,661 | B2 | 9/2005 | Frazer | |
| 7,000,323 | B1 | 2/2006 | Hatcher et al. | |
| 7,007,392 | B2 | 3/2006 | Ping | |
| 7,013,569 | B2 | 3/2006 | Holler | |
| 7,020,969 | B2 * | 4/2006 | Roberson | 30/160 |
| 7,032,315 | B1 | 4/2006 | Busse | |
| 7,040,022 | B2 | 5/2006 | Ping | |
| 7,051,441 | B2 | 5/2006 | Carter, III | |
| 7,059,053 | B2 | 6/2006 | Sakai | |
| 7,062,856 | B2 | 6/2006 | Moser | |
| 7,086,157 | B2 | 8/2006 | Vallotton | |
| 7,107,685 | B1 | 9/2006 | Anderson | |
| 7,107,686 | B2 | 9/2006 | Linn et al. | |
| 7,121,005 | B2 | 10/2006 | Hughes | |
| 7,124,510 | B2 * | 10/2006 | Frazer | 30/161 |
| 7,134,207 | B2 | 11/2006 | Ping | |
| 7,140,110 | B2 | 11/2006 | Lake | |
| 7,165,329 | B2 | 1/2007 | Kao | |
| 7,181,849 | B2 | 2/2007 | Menter | |
| 7,214,127 | B1 | 5/2007 | Thompson et al. | |
| 7,234,241 | B2 * | 6/2007 | Chu | 30/160 |
| 7,243,430 | B1 | 7/2007 | Lerch | |
| 7,246,441 | B1 | 7/2007 | Collins | |
| D553,466 | S | 10/2007 | Powers | |
| 7,275,321 | B2 | 10/2007 | Cheng | |
| 7,284,329 | B1 | 10/2007 | King | |
| 7,293,360 | B2 * | 11/2007 | Steigerwalt et al. | 30/160 |
| D559,939 | S | 1/2008 | Veff, III | |
| 7,313,866 | B2 | 1/2008 | Linn et al. | |
| D561,295 | S | 2/2008 | Taylor | |
| D562,932 | S | 2/2008 | Taylor | |
| 7,325,312 | B1 | 2/2008 | Janich | |
| 7,340,837 | B1 | 3/2008 | Busse | |
| 7,340,838 | B2 | 3/2008 | Onion | |
| 7,421,751 | B2 | 9/2008 | Ruggiero | |
| 7,437,822 | B2 | 10/2008 | Flagg et al. | |
| D580,251 | S | 11/2008 | Watson | |
| 7,451,545 | B2 | 11/2008 | Voros | |
| 7,458,159 | B2 | 12/2008 | Galyean et al. | |
| 7,469,476 | B2 | 12/2008 | Demko | |
| 7,506,446 | B2 | 3/2009 | Onion | |
| 7,513,044 | B2 | 4/2009 | Lake | |
| 7,513,045 | B2 | 4/2009 | Kain | |
| 7,555,839 | B2 | 7/2009 | Koelewyn | |
| 7,562,454 | B2 | 7/2009 | Steigerwalt et al. | |
| 7,578,064 | B2 | 8/2009 | Busse | |
| 7,634,858 | B1 | 12/2009 | Frazer | |
| 7,647,701 | B1 | 1/2010 | Mollick et al. | |

(56) References Cited

U.S. PATENT DOCUMENTS

| | | | | |
|---|---|---|---|---|
| 7,676,932 | B2 | 3/2010 | Grice | |
| RE41,259 | E | 4/2010 | McHenry et al. | |
| 7,698,821 | B2 | 4/2010 | Ralph | |
| 7,748,122 | B2 | 7/2010 | Duey | |
| 7,752,759 | B2 | 7/2010 | Perreault | |
| D621,678 | S | 8/2010 | Huang | |
| D622,805 | S | 8/2010 | Bloch | |
| 7,774,939 | B1 | 8/2010 | Onion | |
| 7,774,940 | B2 | 8/2010 | Frank | |
| 7,779,497 | B2 | 8/2010 | Chiu et al. | |
| 7,827,697 | B2 | 11/2010 | Lake | |
| 7,854,067 | B2 | 12/2010 | Lake | |
| 7,913,398 | B2 | 3/2011 | Chu | |
| D636,052 | S | 4/2011 | Freeman et al. | |
| 7,918,028 | B2 | 4/2011 | Steigerwalt et al. | |
| D638,904 | S | 5/2011 | Freeman et al. | |
| 7,979,990 | B2 | 7/2011 | Hawk et al. | |
| D642,888 | S | 8/2011 | Port et al. | |
| 7,987,601 | B2 * | 8/2011 | Nakamura | 30/161 |
| 8,001,693 | B2 * | 8/2011 | Onion | 30/161 |
| 8,021,216 | B1 | 9/2011 | Moore | |
| 8,028,419 | B2 | 10/2011 | VanHoy | |
| 8,037,612 | B2 | 10/2011 | Hansen et al. | |
| 8,042,276 | B2 | 10/2011 | Lerch et al. | |
| RE42,906 | E * | 11/2011 | Onion | 30/160 |
| 8,046,923 | B2 | 11/2011 | Liu | |
| D653,520 | S | 2/2012 | Chang | |
| 8,109,002 | B2 * | 2/2012 | Frazer | 30/161 |
| 8,112,894 | B2 | 2/2012 | Caswell | |
| D657,435 | S | 4/2012 | Wilke | |
| 8,161,653 | B2 | 4/2012 | Nenadic | |
| D660,676 | S | 5/2012 | Yang-Fu | |
| 8,171,645 | B2 | 5/2012 | Duey | |
| 8,186,065 | B2 | 5/2012 | Onion | |
| 8,215,021 | B2 | 7/2012 | Seber et al. | |
| 8,261,633 | B2 * | 9/2012 | Maxey | 30/161 |
| 8,286,356 | B1 | 10/2012 | Mollick et al. | |
| 8,291,597 | B2 | 10/2012 | Hawk et al. | |
| 8,296,958 | B1 | 10/2012 | Frazer | |
| 8,375,589 | B2 | 2/2013 | Bermer et al. | |
| 8,601,699 | B2 * | 12/2013 | Vellekamp | 30/161 |
| 8,607,460 | B1 * | 12/2013 | Lerch et al. | 30/160 |
| 2001/0016987 | A1 | 8/2001 | Chen | |
| 2002/0066187 | A1 | 6/2002 | Jennings | |
| 2002/0104220 | A1 | 8/2002 | Marfione | |
| 2004/0020058 | A1 | 2/2004 | Vallotton | |
| 2004/0103541 | A1 | 6/2004 | Scarla | |
| 2004/0134075 | A1 | 7/2004 | Chu | |
| 2004/0154169 | A1 | 8/2004 | McCann | |
| 2005/0044717 | A1 | 3/2005 | Nishihara | |
| 2005/0072004 | A1 | 4/2005 | Carter, III | |
| 2005/0097755 | A1 | 5/2005 | Galyean et al. | |
| 2005/0172497 | A1 | 8/2005 | Linn et al. | |
| 2006/0064877 | A1 | 3/2006 | Vallotton et al. | |
| 2006/0080841 | A1 | 4/2006 | Hatcher et al. | |
| 2006/0162168 | A1 * | 7/2006 | Kao | 30/161 |
| 2006/0236549 | A1 * | 10/2006 | Martin | 30/161 |
| 2006/0248728 | A1 | 11/2006 | Gibbs | |
| 2007/0056169 | A1 | 3/2007 | Cheng | |
| 2007/0068002 | A1 | 3/2007 | Onion | |
| 2008/0028903 | A1 | 2/2008 | Greenberg | |
| 2008/0201953 | A1 | 8/2008 | Bremer et al. | |
| 2008/0222896 | A1 | 9/2008 | Marfione et al. | |
| 2008/0276462 | A1 | 11/2008 | Kao | |
| 2009/0013537 | A1 | 1/2009 | Kao | |
| 2009/0144986 | A1 | 6/2009 | Frazer | |
| 2009/0193664 | A1 | 8/2009 | Galyean | |
| 2009/0217533 | A1 | 9/2009 | Kao | |
| 2009/0241348 | A1 * | 10/2009 | Westerfield | 30/161 |
| 2010/0083507 | A1 | 4/2010 | Glesser | |
| 2010/0101095 | A1 | 4/2010 | Prasetya | |
| 2010/0192381 | A1 | 8/2010 | Sakai | |
| 2010/0212163 | A1 | 8/2010 | Liu | |
| 2010/0275449 | A1 | 11/2010 | Collard et al. | |
| 2010/0299934 | A1 | 12/2010 | Vanhoy | |
| 2010/0313427 | A1 | 12/2010 | Hsu | |
| 2011/0010947 | A1 | 1/2011 | Freeman | |
| 2011/0067246 | A1 | 3/2011 | Perez | |
| 2011/0099817 | A1 | 5/2011 | Duey | |
| 2012/0144677 | A1 | 6/2012 | Chang | |
| 2012/0159789 | A9 | 6/2012 | Frazer | |
| 2012/0234142 | A1 | 9/2012 | Onion | |
| 2012/0240412 | A1 * | 9/2012 | Chen | 30/161 |
| 2013/0000129 | A1 | 1/2013 | Huang | |
| 2014/0020252 | A1 * | 1/2014 | Chen | 30/161 |
| 2014/0373364 | A1 * | 12/2014 | Li | 30/156 |

* cited by examiner

KNIFE

CROSS-REFERENCE TO RELATED APPLICATIONS

This application claims priority to U.S. Provisional Application No. 61/656,181, filed Jun. 6, 2012 and to U.S. Provisional Application No. 61/680,398, filed Aug. 7, 2012, the entire contents of which are all incorporated herein by reference herein.

BACKGROUND

The present invention relates to knives.

Folding knives typically include a handle and a blade that pivots with respect to the handle so that the blade can be moved within the handle when the blade is not in use.

SUMMARY

In one embodiment, the invention provides a knife including a handle, a blade including a cutting edge and pivotally coupled to the handle so that the blade can pivot about a pivot point relative to the handle between an extended position and a retracted position, in the retracted position the blade is substantially received within the handle and in the extended position the cutting edge is exposed. The knife further includes a frame at least partially within the handle, the frame including a first locking member and a second locking member, the first locking member is at least partially formed from a leaf spring portion of the frame, the second locking member is at least partially formed from a second leaf spring portion of the frame. The second locking member engages the blade to retain the blade in the retracted position and the second locking member is movable out of engagement with the blade to allow movement of the blade from the retracted position to the extended position. The first locking member engages the blade to retain the blade in the extended position and the first locking member is movable out of engagement with the blade to allow movement of the blade from the extended position to the retracted position.

In another embodiment the invention provides a knife including a first handle portion, a second handle portion, a blade including a cutting edge, a front end portion, and a rear end portion. The rear end portion includes a generally flat portion, a locking aperture, and the rear end portion is pivotally coupled to the first and second handle portions so that the blade can pivot about a pivot point relative to the first and second handle portions between an extended position and a retracted position, in the retracted position the blade is substantially received between the first and second handle portions and in the extended position the cutting edge is exposed. The knife further includes a frame between the first and second handle portions, the frame including a first locking member and a second locking member, the first locking member is at least partially formed from a leaf spring portion of the frame and the first locking member includes a first actuator that is a tab portion of the frame, the second locking member is at least partially formed from a second leaf spring portion of the frame, the second locking member further includes a projection and a second actuator that includes a push button to move the projection against the bias of the second leaf spring portion. The projection of the second locking member is received in the locking aperture of the blade to retain the blade in the retracted position and the projection is movable out of the locking aperture via the push button to allow movement of the blade from the retracted position to the extended position.

The first locking member engages the generally flat portion of the blade to retain the blade in the extended position and the first locking member is movable out of engagement with the generally flat portion of the blade via the tab to allow movement of the blade from the extended position to the retracted position.

Other aspects of the invention will become apparent by consideration of the detailed description and accompanying drawings.

Figure 1:
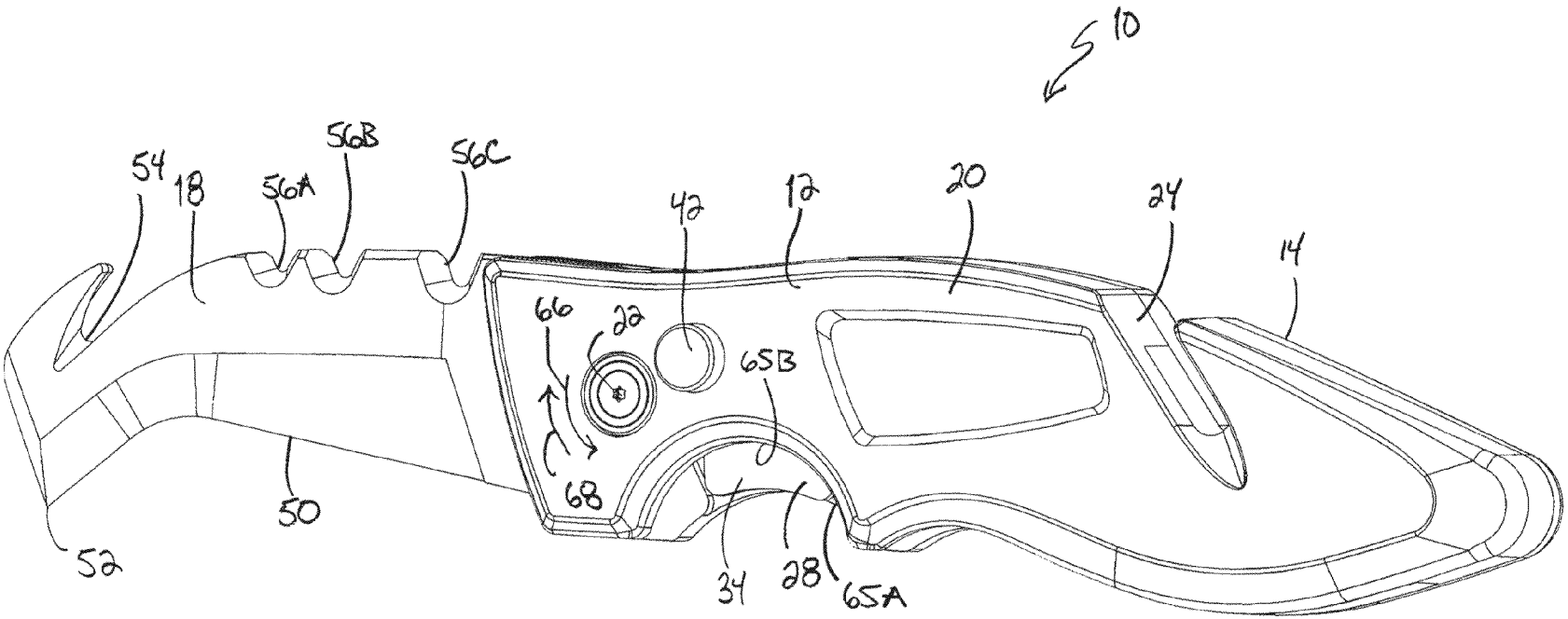
FIG. 1 is a perspective view of a knife according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a knife 10. The knife 10 includes a first handle portion 12, a second handle portion 14, a frame 16 between the handle portions 12, 14, and a blade 18 pivotally coupled to the handle portions 12, 14.

The handle portions 12 and 14 each generally define half of a handle 20 of the knife 10 and the blade 18 is pivotally coupled to the handle 20 so that the blade 18 can pivot about a pivot point 22 between an extended position (FIG. 1) and retracted or closed positions where the blade 18 is substantially received and stored within the handle 20 between the portions 12 and 14. The handle 20 includes an elongated recess 24 adjacent a rear end of the handle 20. The recess exposes a relatively small portion of the blade 18 when the blade 18 is closed so that the blade 18 can be used to cut wire, string, and the like by placing the wire, string, etc. in the recess 24.

Figure 3:
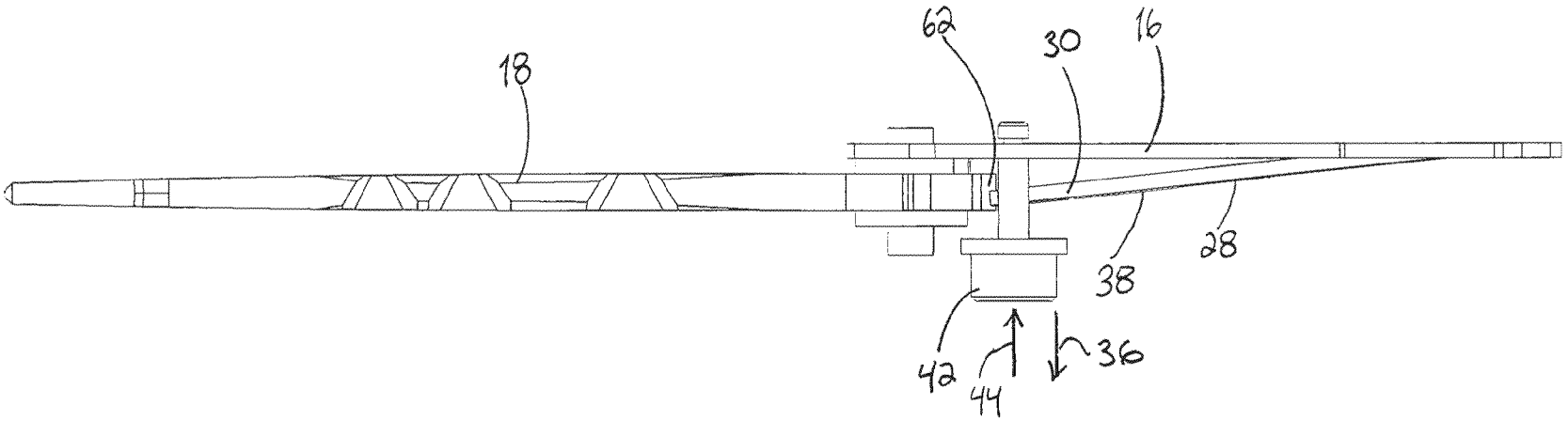
FIG. 3 is a top view of the knife of FIG. 1 with the handle portions of the knife removed.

The frame 16 includes a first locking member 28 and a second locking member 30. The first locking member 28 is formed from a leaf spring or cantilevered spring portion 32 of the frame 16 and the locking member 28 includes an actuator 34, which is a tab portion of the frame 16. The first locking member 28 is biased in the direction of arrow 36, as illustrated in FIG. 1I FIG. 3, and retains the blade 18 in the extended position, as will be discussed in more detail below. The second locking member 30 is also formed from a leaf spring or cantilevered spring portion 38 of the frame 16. The second locking member 30 further includes a projection 40 located at an end of the spring portion 38. An actuator 42, which is a push button in the illustrated embodiment, is coupled to spring portion 38 to move the projection 40 in the direction of arrow 44 against the bias of the spring portion 38, which is in the direction of arrow 36 (FIG. 4).

The illustrated knife 10 includes the blade 18, which is particularly suited for use by an electrician. The blade 18 includes a sharp cutting edge 50 that extends along a bottom edge of the blade 18, which can be used to cut any suitable material. A point 52 is located near a front end of the blade 18. The point 52 can be used to splice Romex® non-metallic building wire or cut and remove the outer insulation from such a wire. A top edge of the blade 18 includes a sharp hook 54 that can be used to cut packaging, strip wire, and the like. The hook 54 is located adjacent the front end of the blade along with the point 52. The top edge of the blade 18 also includes arcuate cutting edges 56A, 56B, 56C that from generally semi-circular or actuate recesses that open toward the top edge of the blade 18. The cutting edges 56A, 56B, 56C, each have a different length so that the edges 56A, 56B, 56C are sized for different sizes or different gauge wires. The edges 56A, 56B, 56C can be used to strip insulation from wires, such as the conductive wires inside the outer insulation of Romex® non-metallic building wire when the blade 18 is in either the extended or retracted positions.

The blade 18 is pivotally coupled to the frame 16 and the handle 20 adjacent a rear end portion 58 of the blade 18. The rear end portion 58 of the blade includes a locking aperture 60, a generally flat portion 62, and a crescent shaped recess 64.

Figure 2:
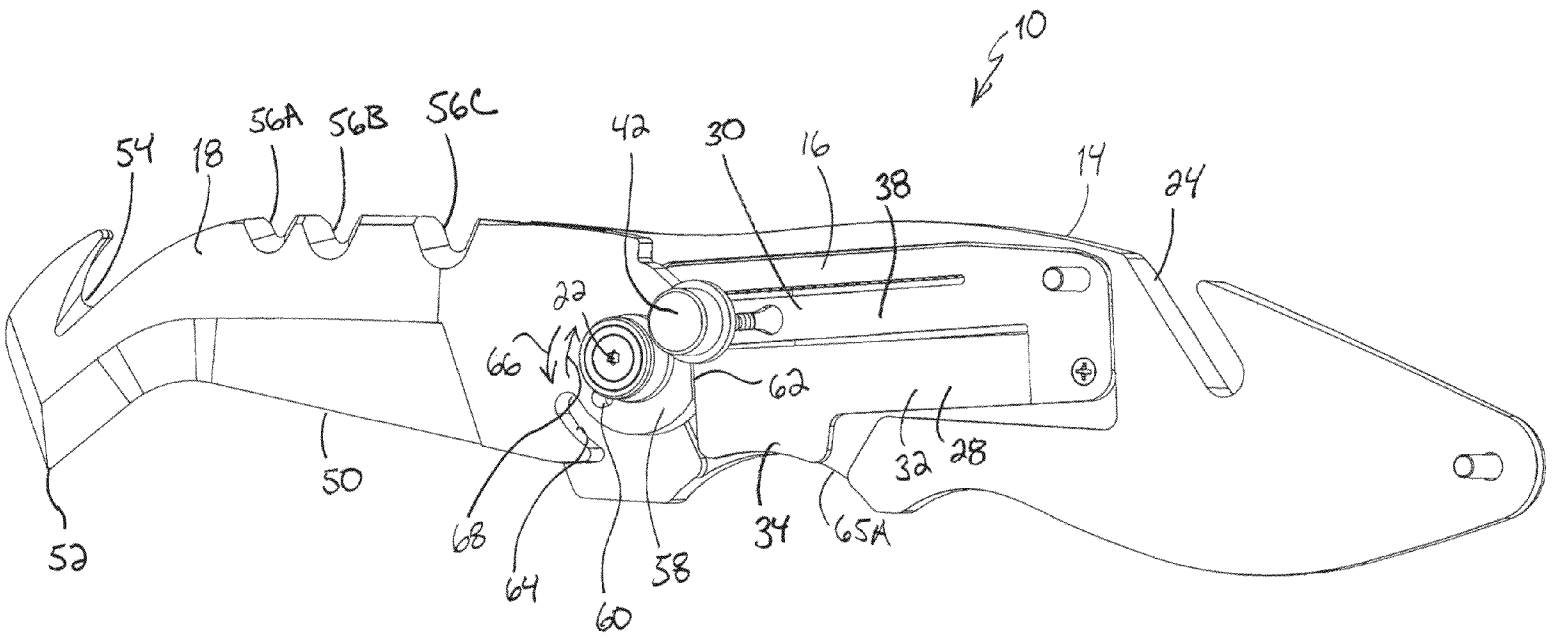
FIG. 2 is a perspective view of the knife of FIG. 1 with a handle portion of the knife removed.
Figure 4:
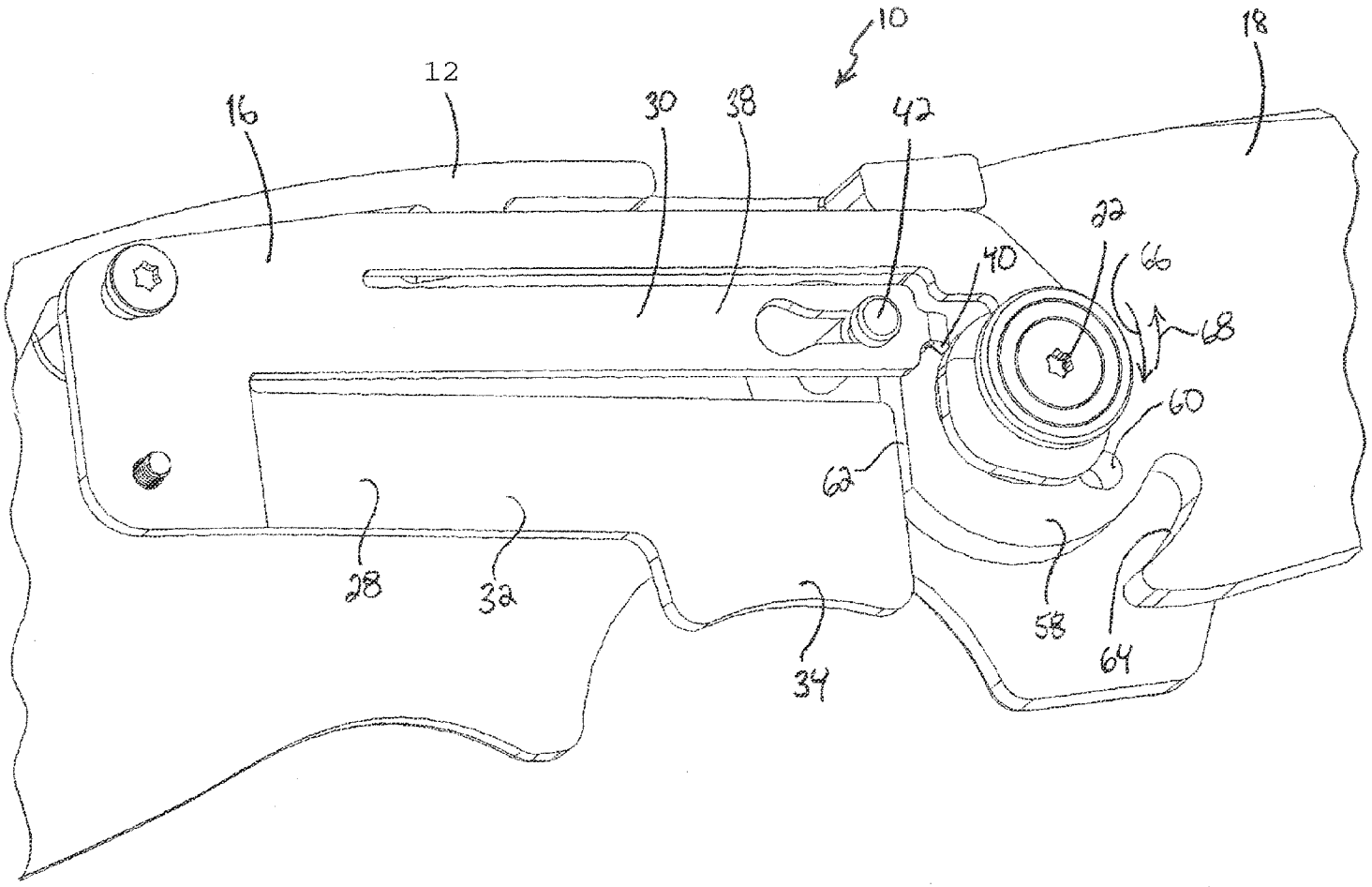
FIG. 4 is an enlarged perspective view of the knife of FIG. 1 with a handle portion removed.

In operation, to pivot the blade 18 between the extended position (FIGS. 1-4) and the retracted or closed position where the blade 18 is received within the handle 20, the user pushes the tab 34 of the first locking member 28 in the direction of arrow 44 of FIG. 4 against the bias of the spring portion 28. The user pushes the tab 34 in the direction of arrow 44 to push the first locking member 28 out of engagement with the flat portion 62 of the blade 18. Engagement between the flat portion 62 of the blade 18 and the locking member 28 retains the blade 18 in the extended position. With the flat portion 62 no longer engaged with the locking member 28, the user can pivot the blade 18 about the pivot point 22 in the direction of arrow 66 to the closed position. The recess 64 in the blade 18 allows the blade 18 to pivot to the closed position without being obstructed by the actuator 42 of the second locking member 30. Also, as illustrated in FIGS. 1 and 2, the second handle portion 14 has a cut-out 65A that is smaller than an adjacent cut-out 65B of the first handle portion 12. The cut-out 65B is sized to permit the user to push the tab 35 from a first or left side of the knife 10 and the cut-out 65A is sized to inhibit the user from inadvertently pushing the tab 35 from a second or right side of the knife 10.

When the blade 18 reaches the closed position, the bias of the second locking member 30 in the direction of arrow 36 by the spring portion 38 automatically causes the projection 40 to move into the locking aperture 60 of the blade 18. With the projection 40 extending into the locking aperture 60, the blade 18 is held in the closed position. To move the blade 18 back to the extended position (FIGS. 1-4), the user pushes the actuator 42 in the direction of arrow 44, which causes the projection 40 to move out of the locking aperture 60. With the projection 40 held out of the aperture 60, the user can pivot the blade 18 about the pivot point 22 in the direction of arrow 68 to the extended or open position. When the blade 18 reaches the fully extended position, the spring portion 32 of the first locking member 28 causes the first locking member 28 to automatically move in the direction of arrow 36 until the locking member 28 engages the flat portion 62 of the blade 18 and complimentary flat portions of the blade 18 and locking member 28 hold the blade 18 in the extended position. Thus, the knife 10 includes the first locking member 28 that holds the blade 18 in the extended position and is actuated to allow the user to close the blade 18 and the knife 10 includes the second locking member 30 that holds the blade in the closed position and is actuated to allow the user to open the blade 18.

Figure 5:
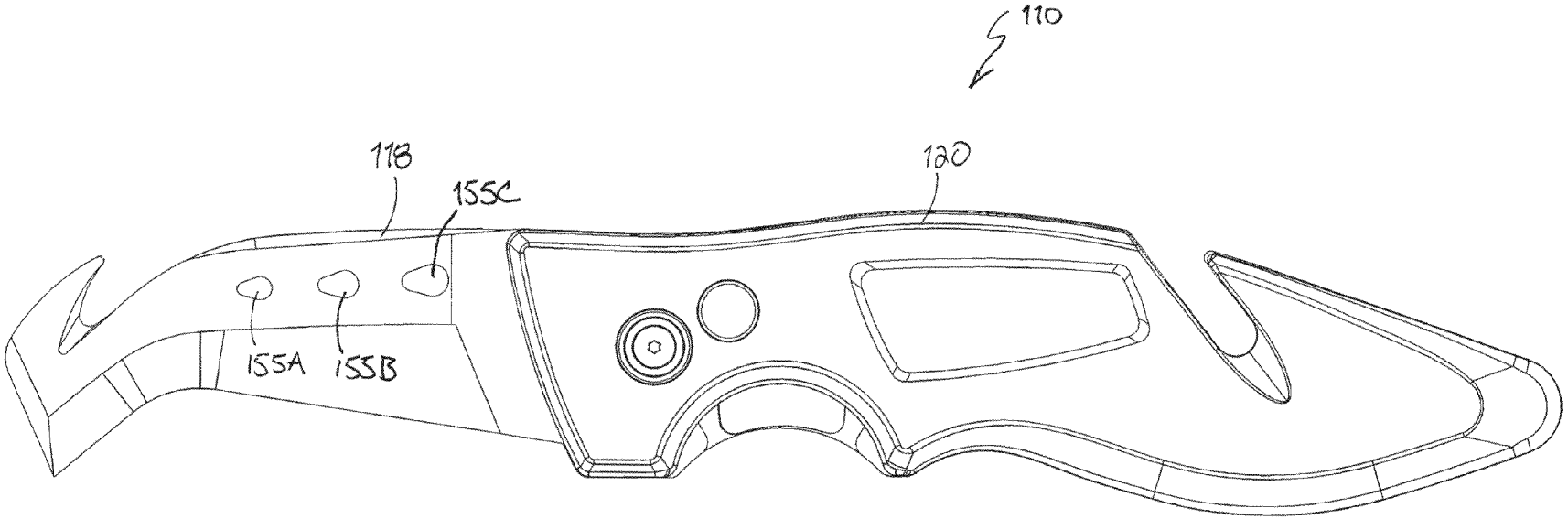
FIG. 5 is a first side view of a knife according to another embodiment.
Figure 6:
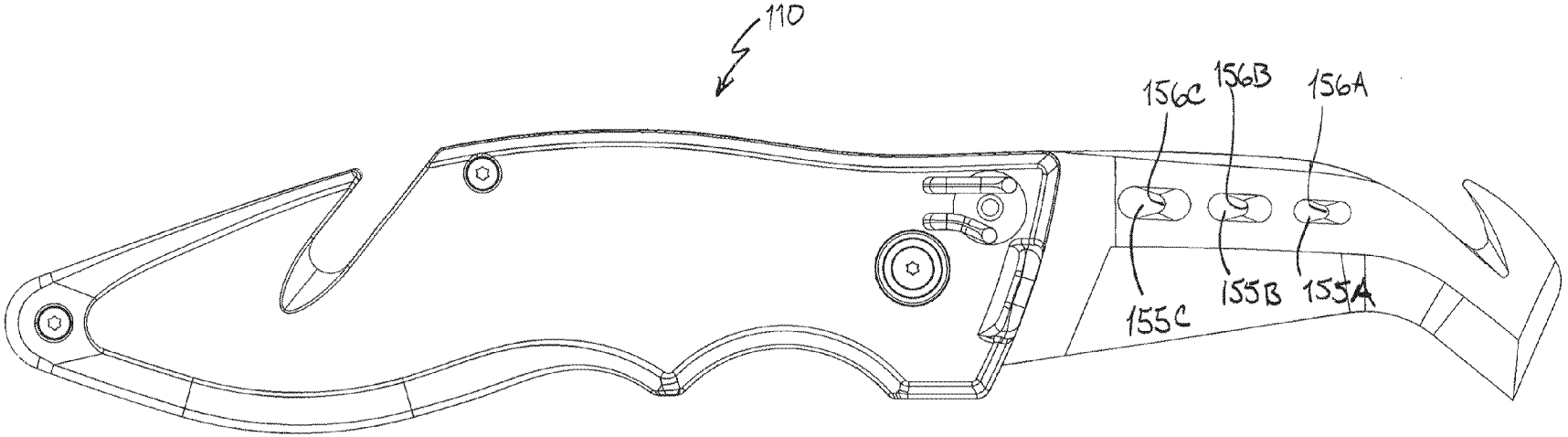
FIG. 6 is a second side view of the knife of FIG. 5.
Figure 7:
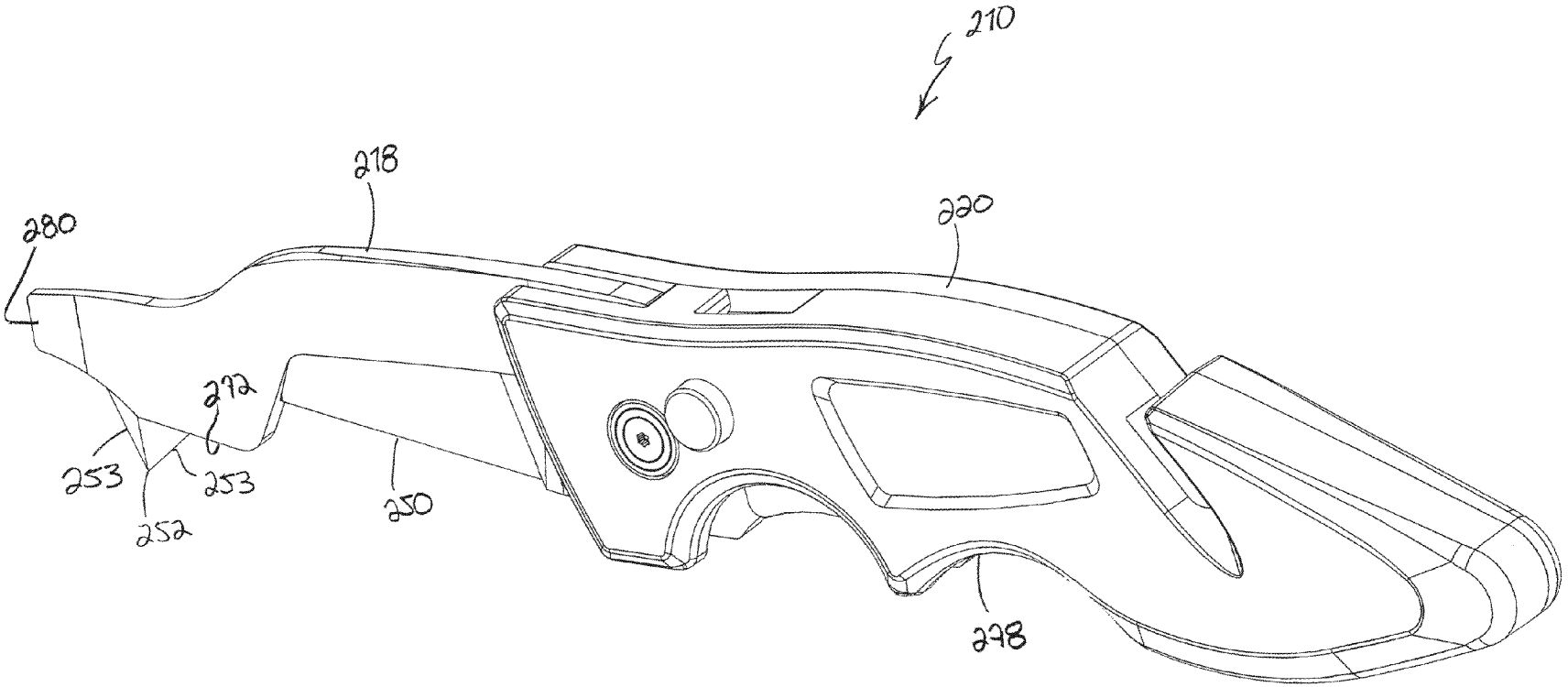
FIG. 7 is a perspective view of a knife according to another embodiment.
Figure 8:
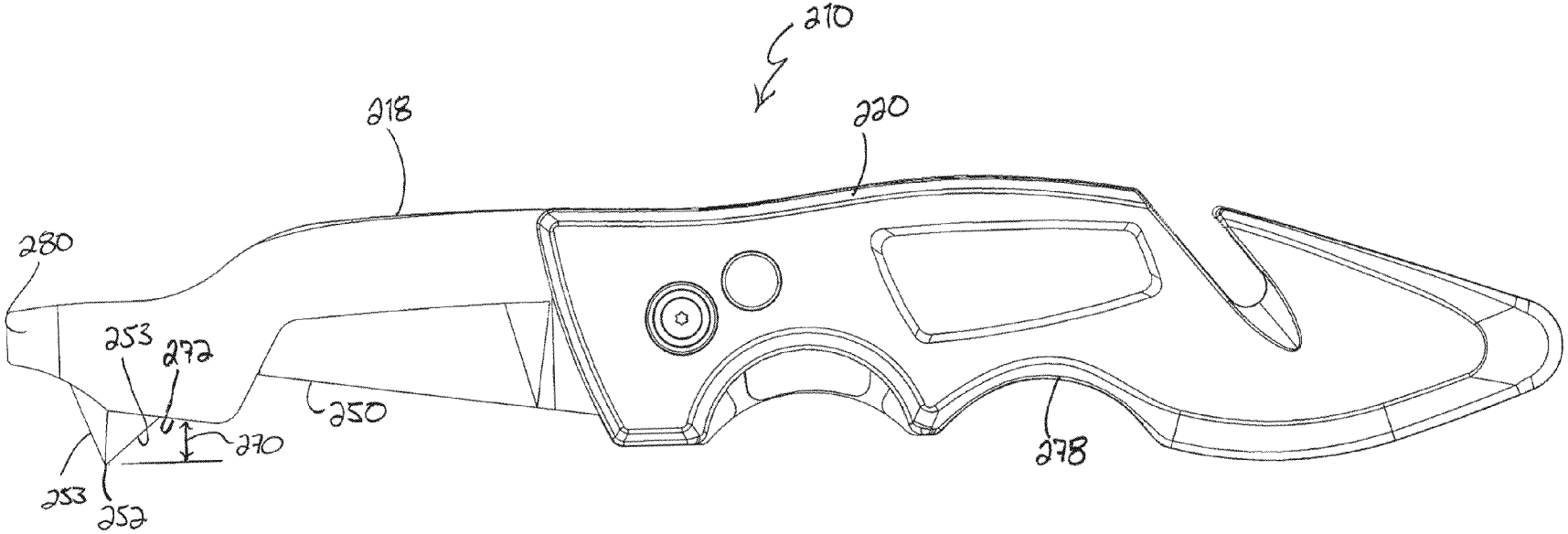
FIG. 8 is a first side view of the knife of FIG. 7.
Figure 9:
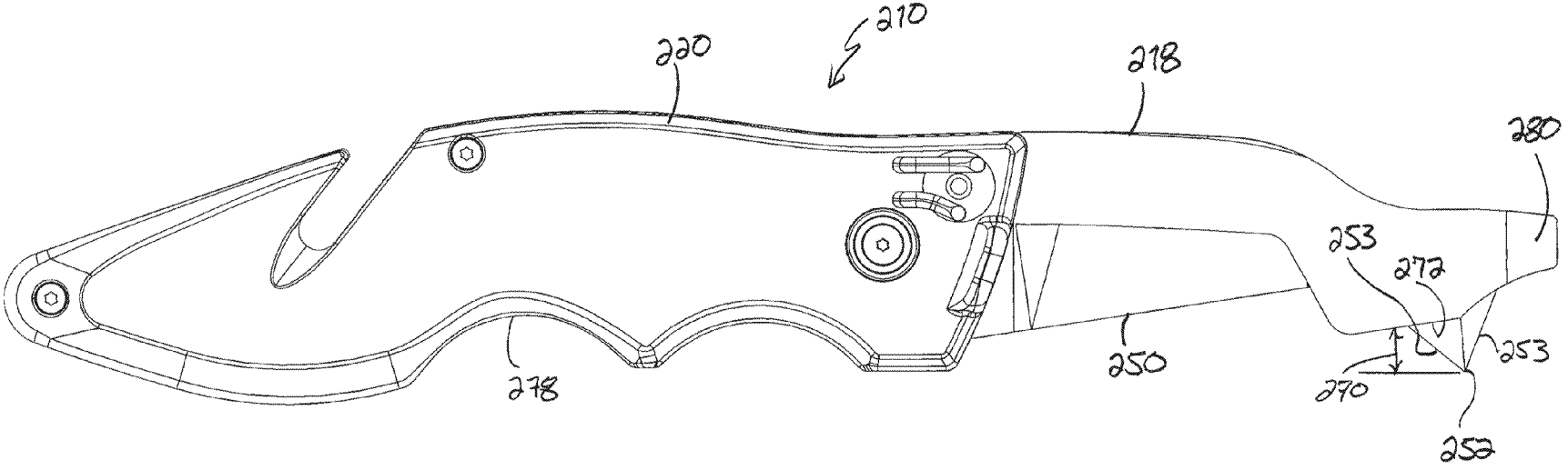
FIG. 9 is a second side view of the knife of FIG. 7.

FIGS. 5 and 6 illustrate a knife 110 according to another embodiment. The knife 110 includes features similar to the knife 10 described above and only differences between the knives 10 and 110 will be discussed in detail below and like components have been given like reference numbers plus 100. The knife 110 includes a blade 118. The blade 118 includes apertures 155A, 155B, and 155C that extend through the blade 118 and include arcuate cutting edges 156A, 156B, 156C. The apertures 155A, 155B, 155C and cutting edges 156A, 156B, and 156C can be used to strip wire, cut wire, cable, and the like similar to the cutting edges 56A, 56B, 56C discussed above with regard to FIGS. 1-4. The apertures 155A, 155B, 155C and the cutting edges 156A, 156B, and 156C having different sizes in order to cut and strip different gauge wires.

Figure 10:
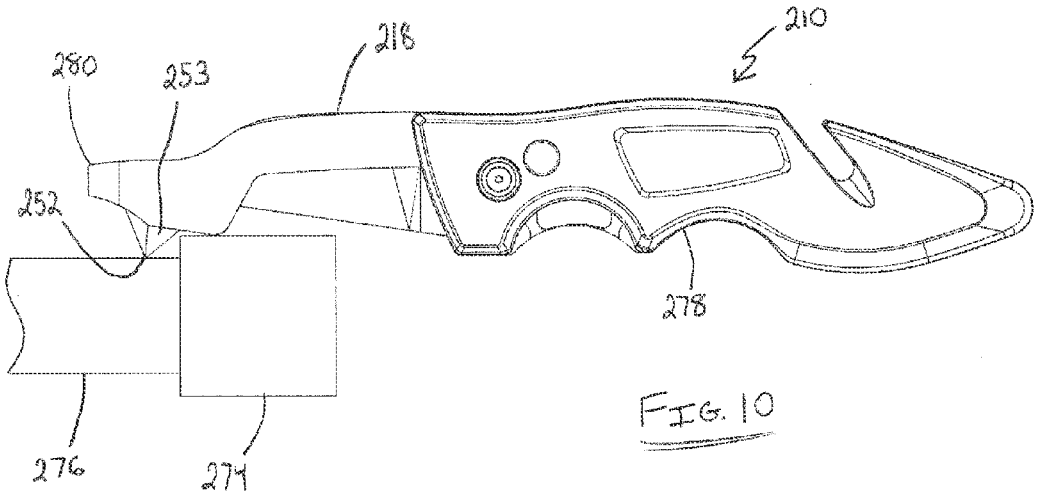
FIG. 10 illustrates the knife of FIG. 7 in one cutting application of the knife.
Figure 11:
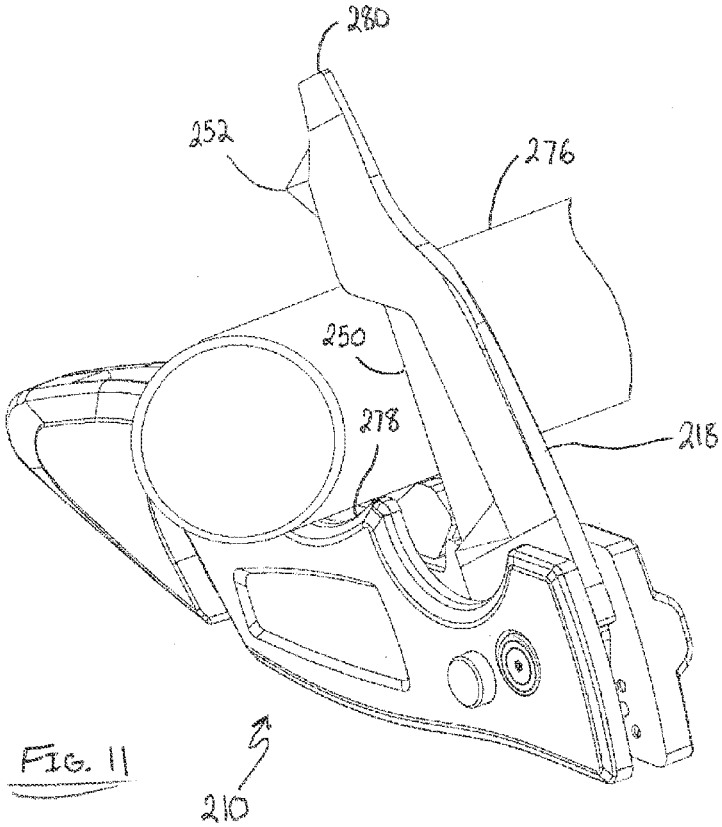
FIG. 11 illustrates the knife of FIG. 7 in a second cutting application of the knife.

FIGS. 7-11 illustrate a knife 210 according to another embodiment. The knife 210 includes features similar to the knife 10 described above and only differences between the knives 10 and 210 will be discussed in detail below and like components have been given like references numbers plus 200. The knife 210 includes a blade 218 that is particularly suited for use by a plumber. The blade 218 includes a cutting edge 250 that extends along a bottom edge of the blade 218. The blade 218 further includes a sharp projection 252 having knife-type edges 253 that extend down a distance 270 from a generally flat portion 272 that is not sharp. The projection 252 and edges 253 can be used to cut couplings, such as a plastic coupling 274 of a cross linked polyethylene (PEX) tube 276 as illustrated in FIG. 10. During such an application, the flat portion 272 acts as a guide to gauge the depth of the cut by the projection 252 and the edges 253. Also, the handle 220 of the knife 210 includes a semi-circular recess 278 located along a bottom surface of the handle 220. As illustrated in FIG. 11, the tube 276 can be placed in the recess 278 and the blade 220 moved into contact with the tube 276 and then the user can rotate the tube 278 to cut the tube 278 using the cutting edge 250. In addition to cutting the PEX tube, the application illustrated in FIG. 11 can also be used to cut thin wall polypropylene tubing, often used for p traps in plumbing applications. Also, the blade 218 includes a flat portion 280, which is generally in the form of a flat head screw driver head 280, that can be used to scrape, pry couplings, and rotates fasters, such as screws used in couplings.

Figure 12:
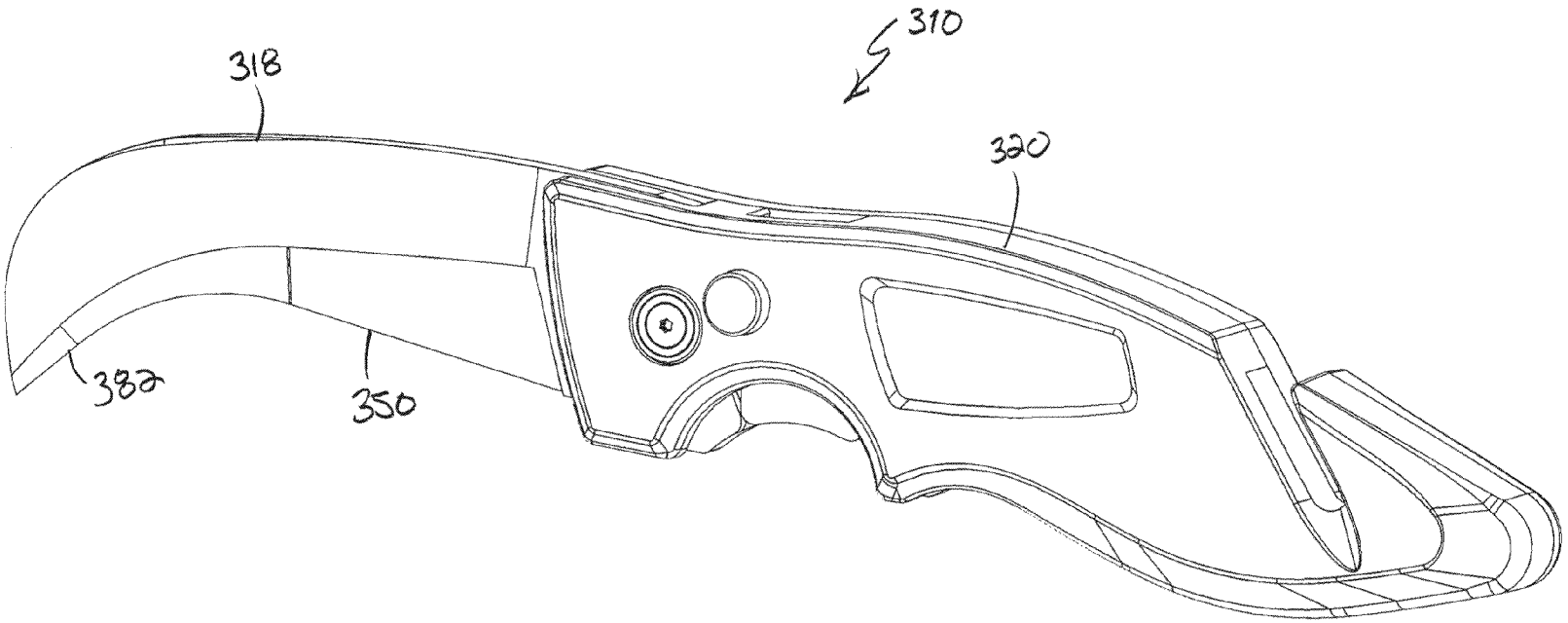
FIG. 12 is a perspective view of a knife according to another embodiment.
Figure 13:
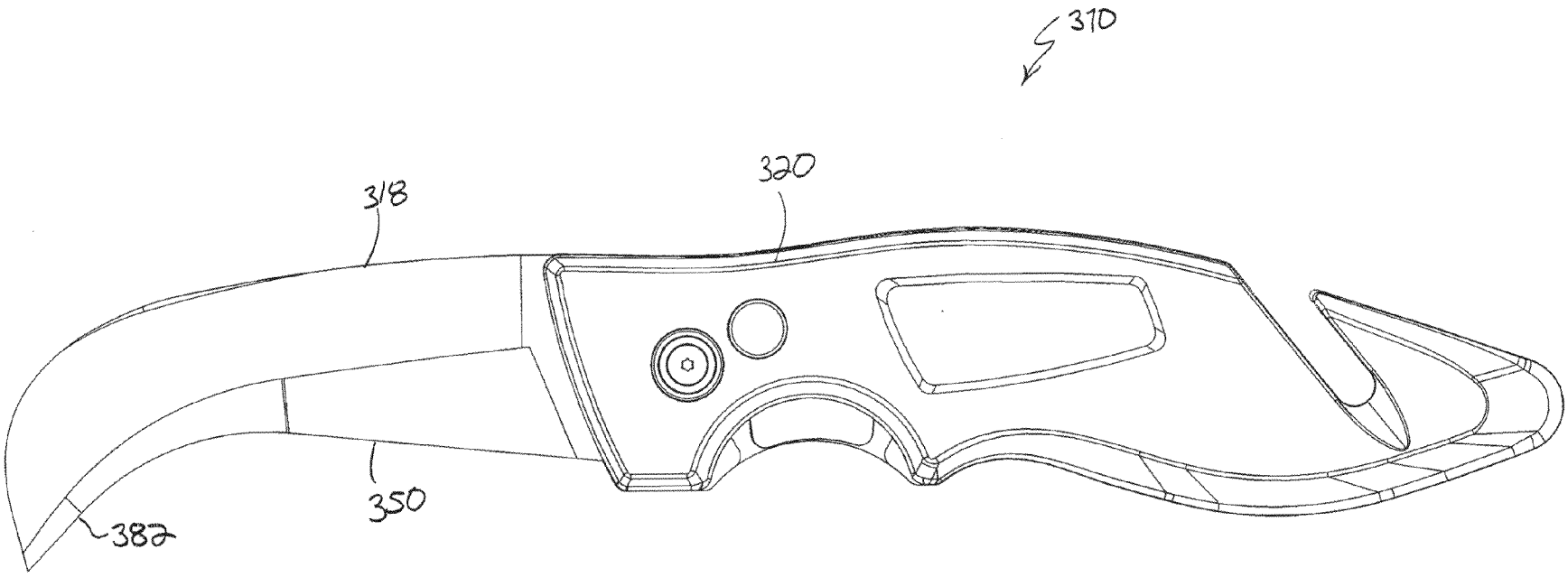
FIG. 13 is a first side view of the knife of FIG. 12.
Figure 14:
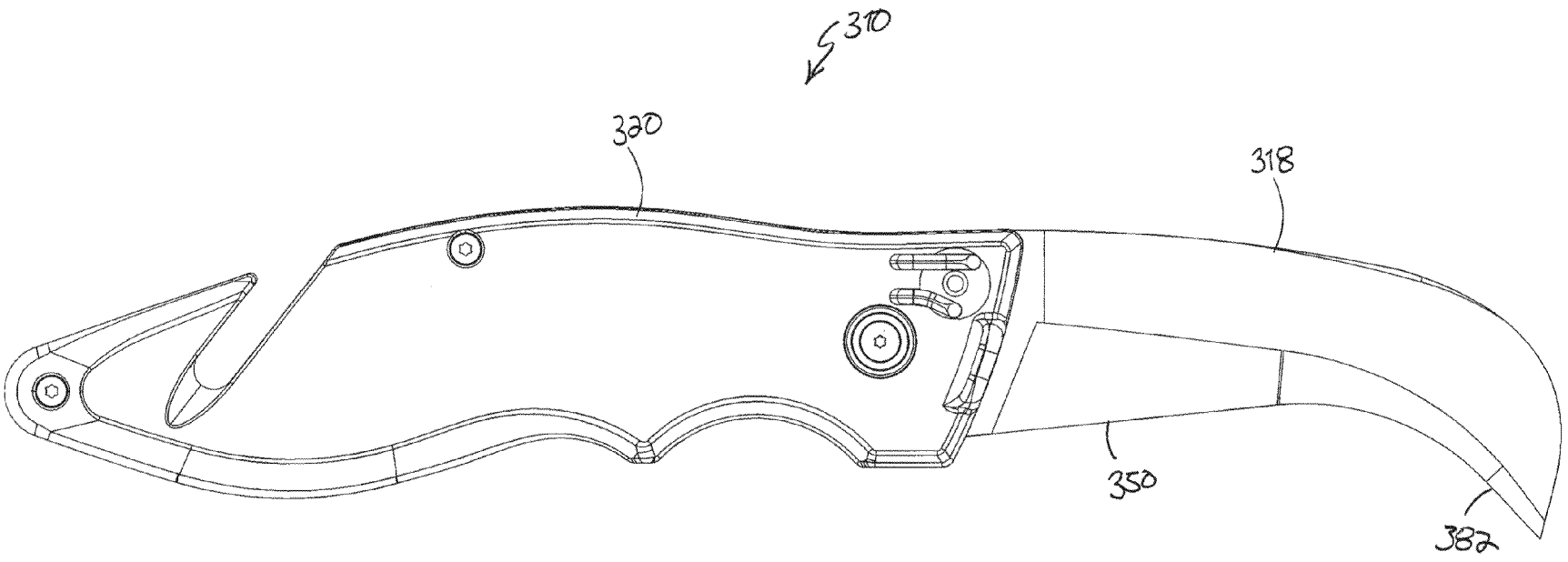
FIG. 14 is a second side view of the knife of FIG. 12.
Figure 15:
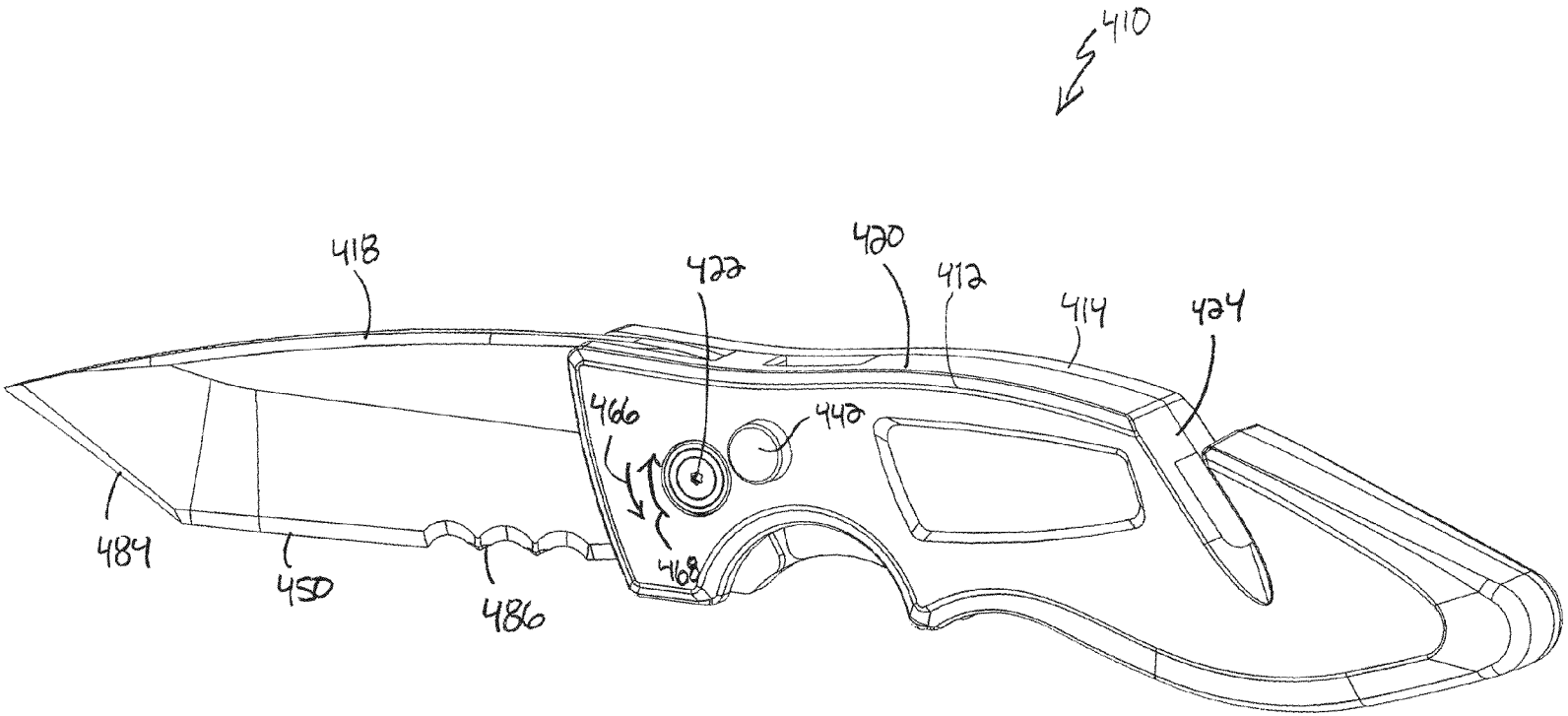
FIG. 15 is a perspective view of a knife according to another embodiment.
Figure 16:
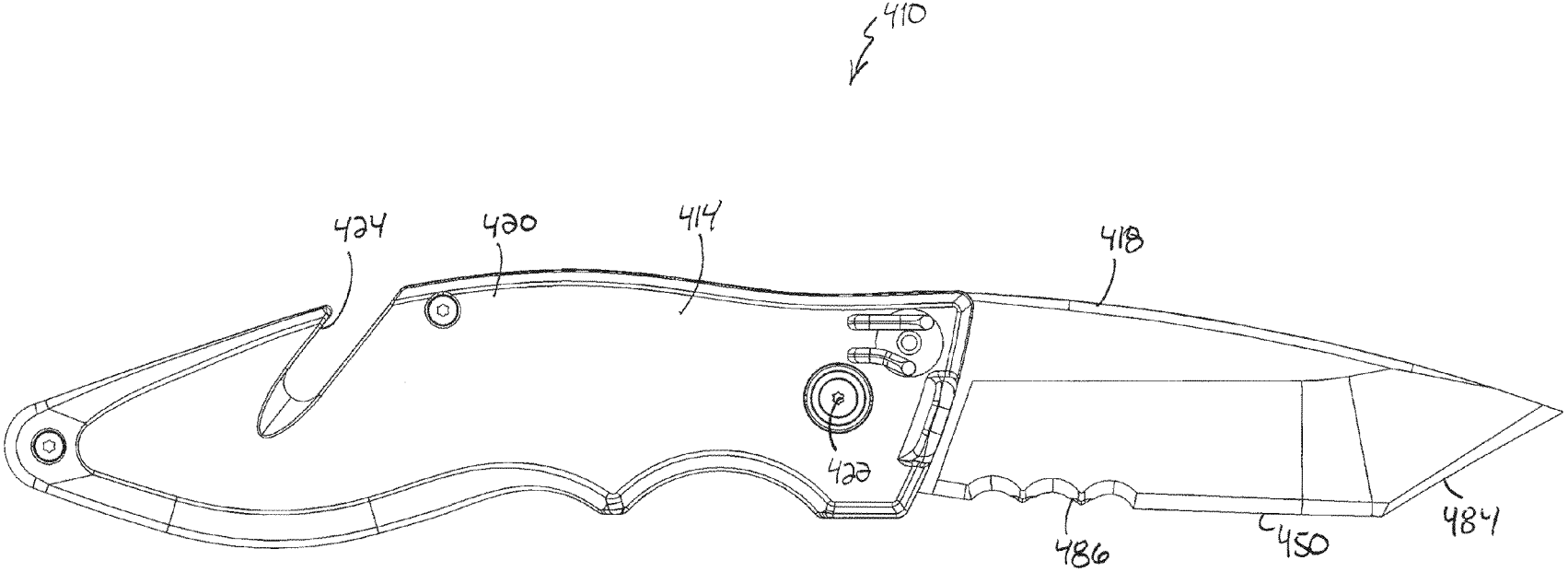
FIG. 16 is a first side view of the knife of FIG. 15.

FIGS. 12-14 illustrate a knife 310 according to another embodiment. The knife 310 includes features similar to the knife 10 described above and only differences between the knives 10 and 310 will be discussed detail below and like components have been given like reference numbers plus 300. The knife 310 includes a blade 318 that is particularly suited for use by someone installing flooring or the like. The blade 318 includes a cutting edge 350 along a bottom edge of the blade 318. Also, the blade 318 includes a curved cutting edge 382 located along a front portion of the blade 318. The cutting edges 382 and 350 form a continuous cutting edge. The blade 318 is particularly suited for cutting flooring, such as linoleum flooring, carpeting and the like.

Figure 17:
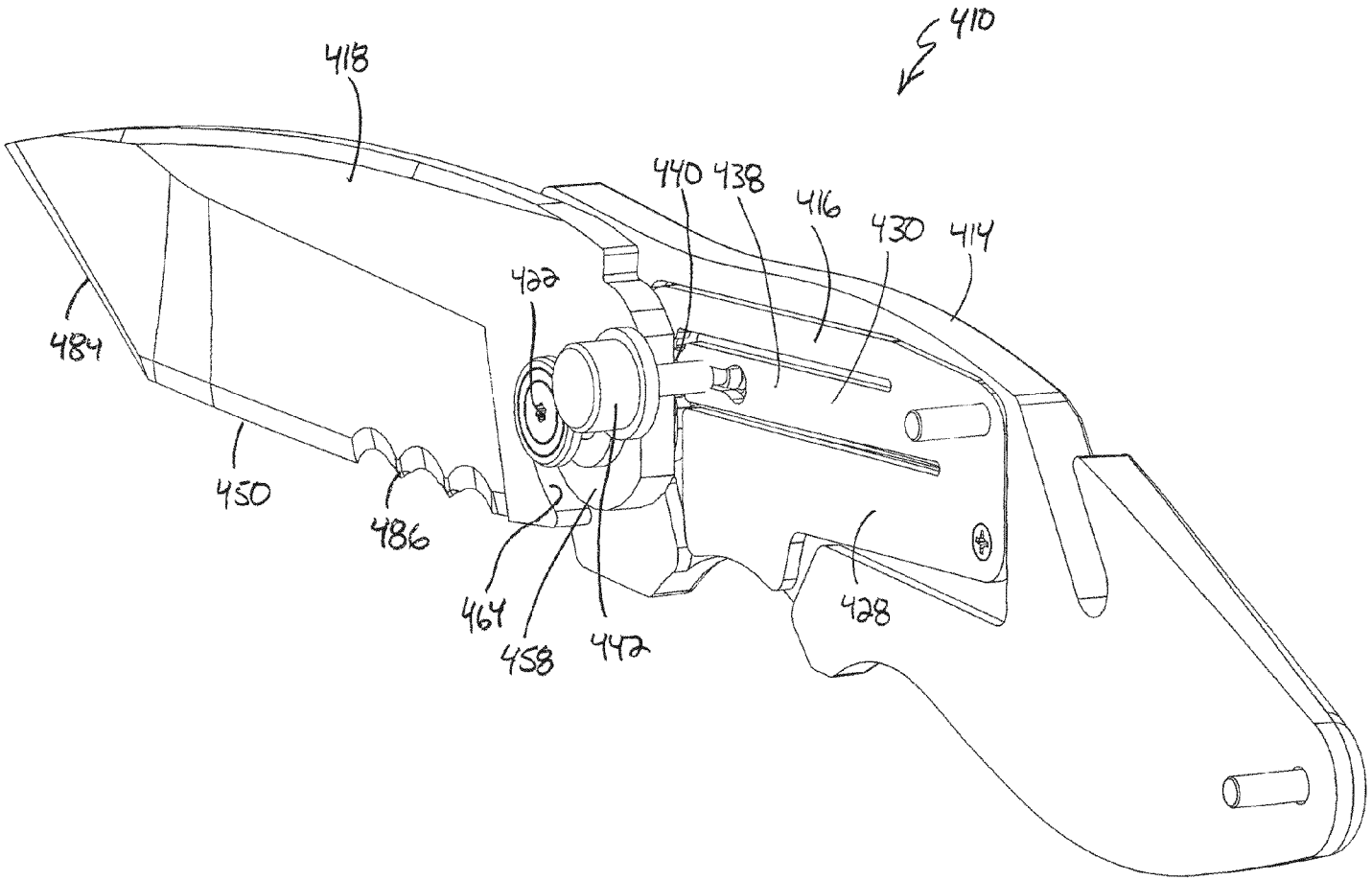
FIG. 17 is a perspective view of the knife of FIG. 15 with a handle portion of the knife removed.
Figure 18:
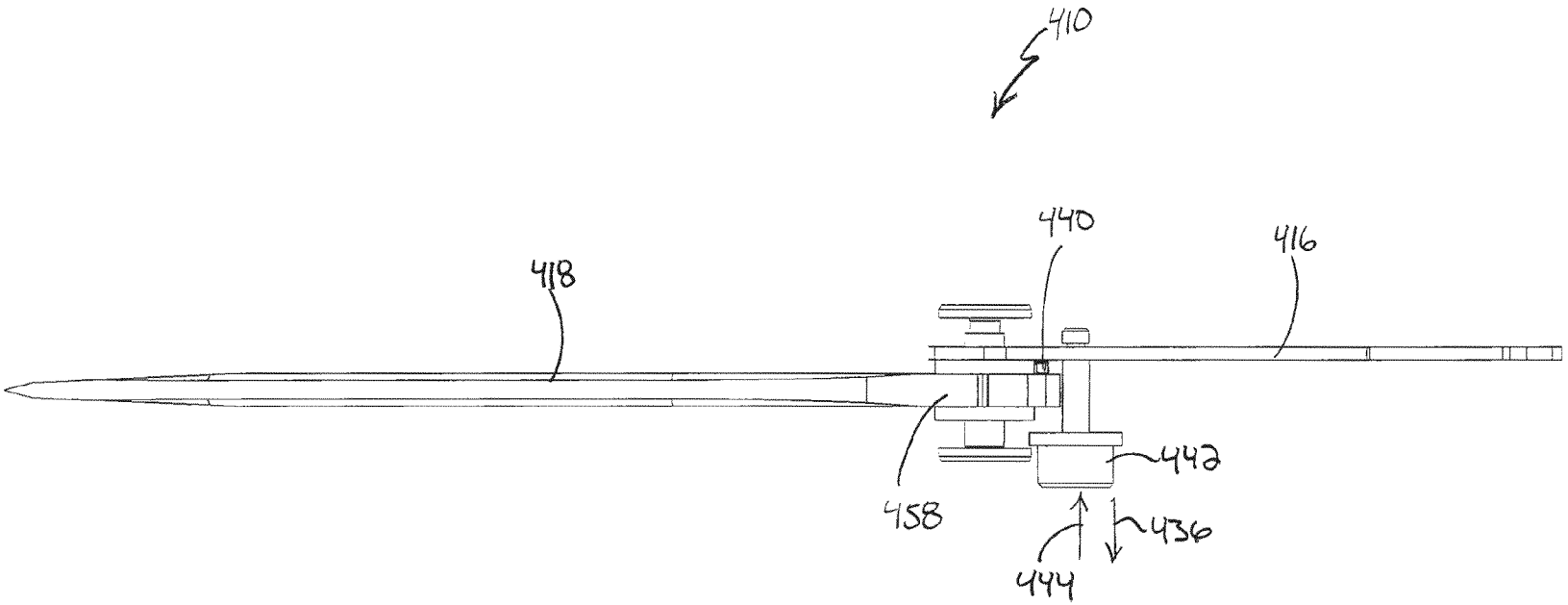
FIG. 18 is a top view of the knife of FIG. 15 with the handle portions removed.
Figure 19:
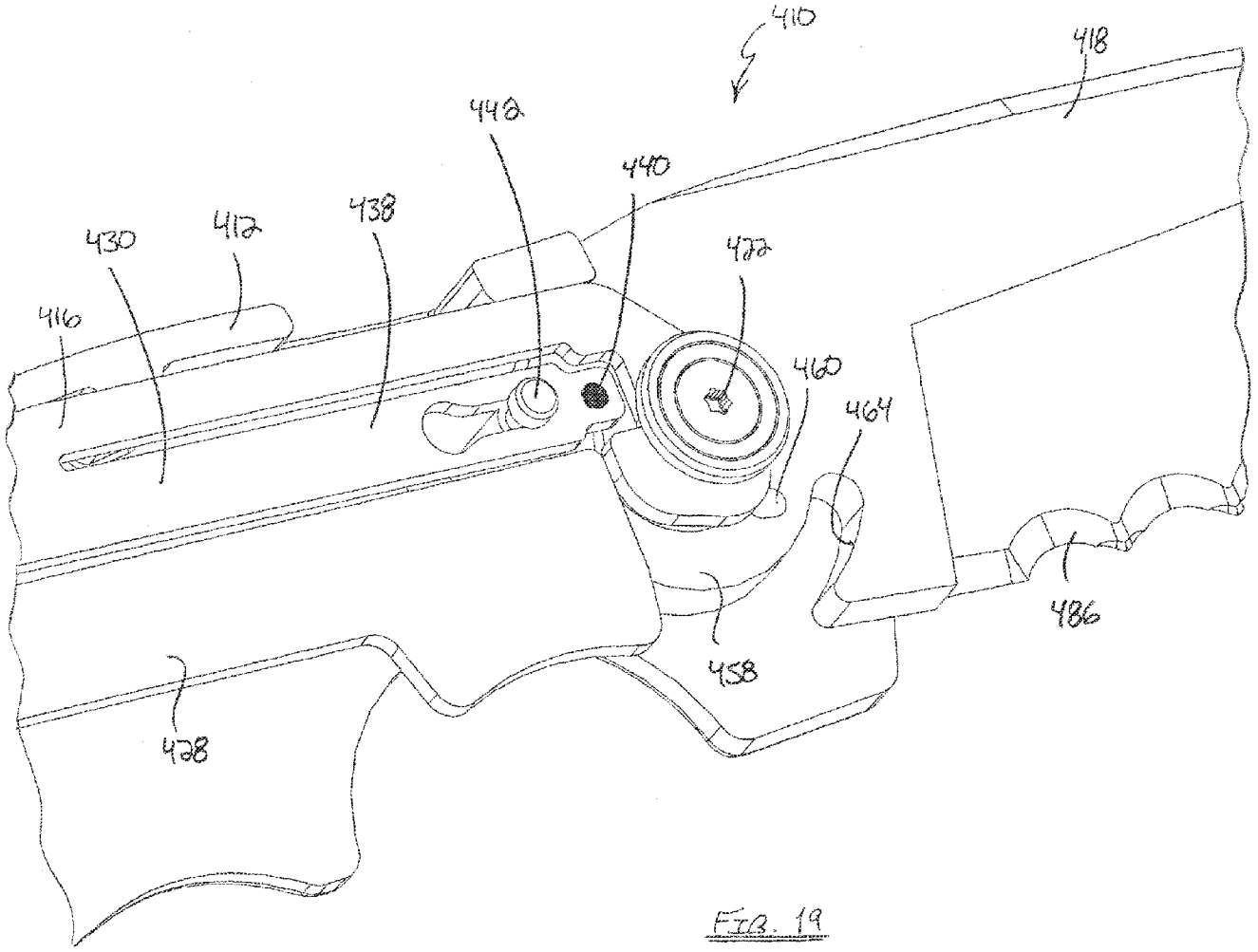
FIG. 19 is an enlarged perspective view of the knife of FIG. 15 with a handle portion removed.
Figure 20:
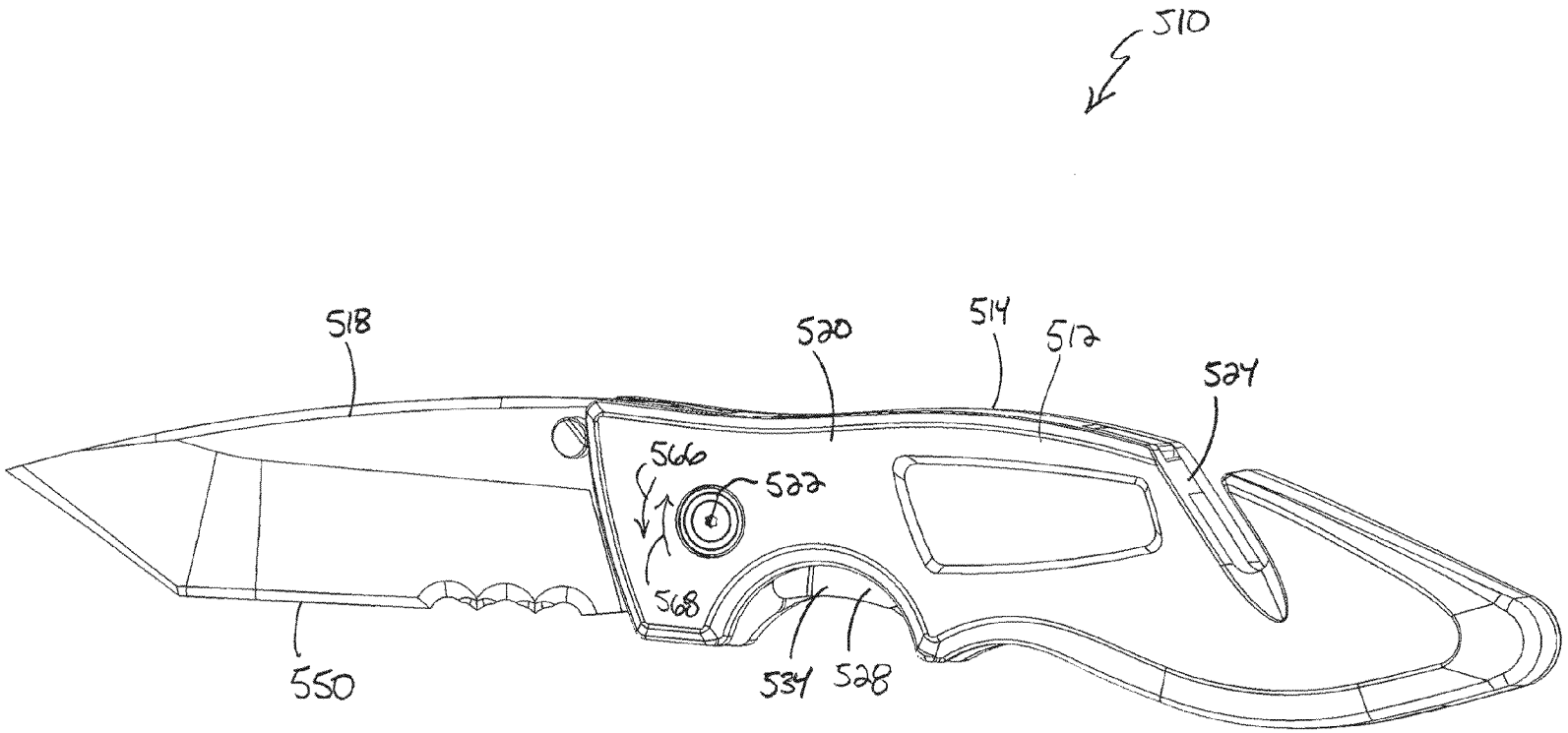
FIG. 20 is a perspective view of a knife according to another embodiment.
Figure 21:
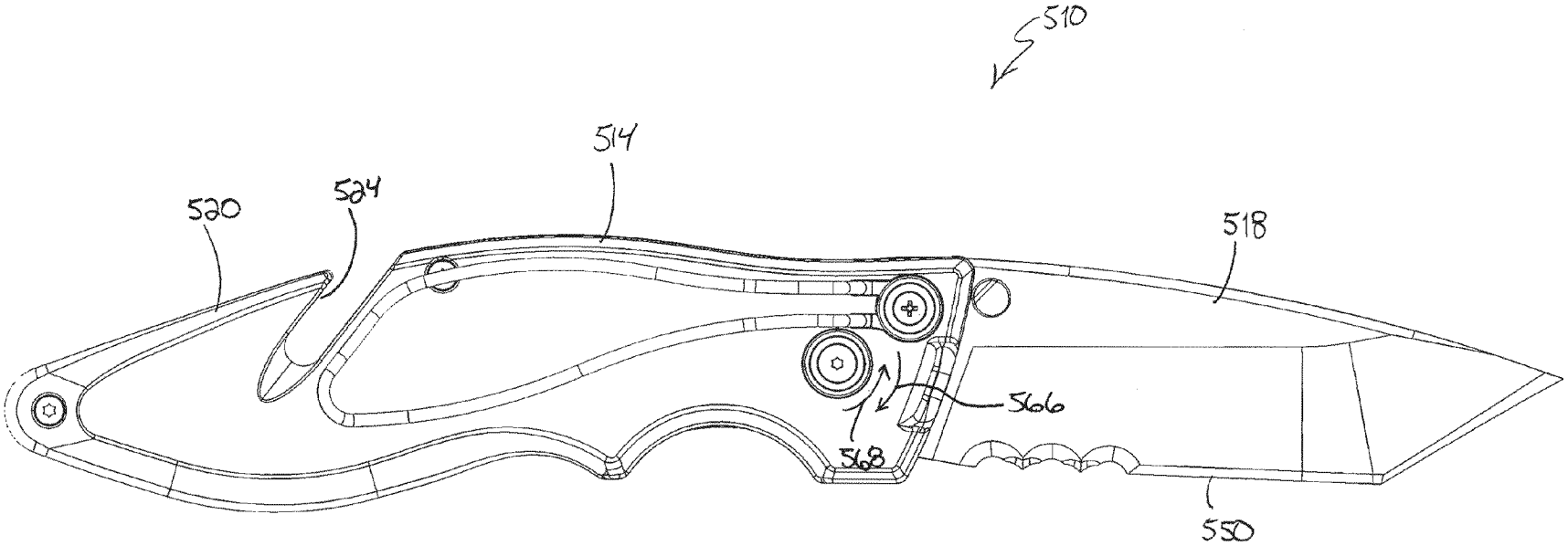
FIG. 21 is a first side view of the knife of FIG. 20.
Figure 22:
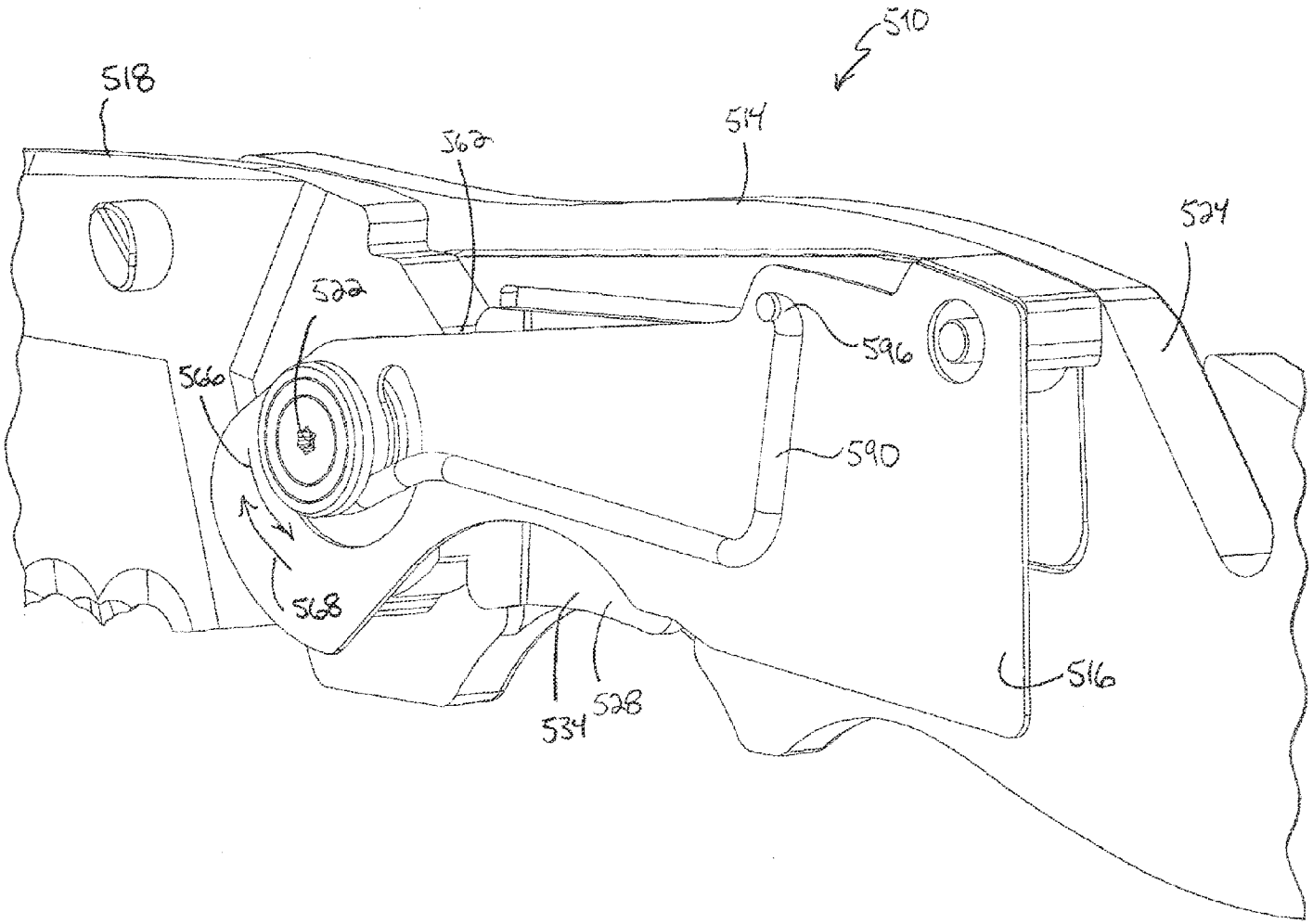
FIG. 22 is a perspective view of the knife of FIG. 20 with a handle portion removed.

FIGS. 15-19 illustrate a knife 410 according to another embodiment. The knife 410 includes features similar to the knife 10 described above and only differences between the knives 10 and 410 will be discussed in detail below and like components have been given like reference numbers plus 400. The knife 410 includes a blade 418 including a cutting edge 450, an angled cutting edge 484 adjacent a front end of the blade 418 and a serrated cutting edge 486 adjacent a rear end of the blade 418. The blade 418 is particularly suited for outdoor recreation purposes, such as hunting, camping, and the like. As best seen in FIGS. 17-18, the portion 428 of the frame 416 is not spring biased like the first locking member 28 of the frame 16 of the knife 10. Accordingly, the portion 428 of the frame 416 does not hold the blade 418 in the extended position like the first locking member 28 of the knife 10 of FIGS. 1-4. The knife 410 does include the locking member 430 similar to the locking member 30 discussed above with regard to the knife 10. The blade 418 includes the aperture 460 that receives projection 440 to hold the blade 418 in the extended position (as discussed above with regard to the knife 10). Also, the blade 418 can include a second locking aperture to receive the projection 440 to hold the blade 418 in the extended position. Accordingly, the user pushes the actuator 442 to allow the user to move the blade 418 between both the extended and retracted/closed positions. In other embodiments, the blade can omit the second locking aperture such that the blade is not locked in the open position.

FIGS. 20-25 illustrate a knife 510 according to another embodiment. The knife 510 includes a first handle portion 512, a second handle portion 514, a frame 516 between the handle portions 512, 514, and a blade 518 pivotally coupled to the handle portions 512, 514.

The handle portions 512 and 514 each generally define half of a handle 520 of the knife 510 and the blade 518 is pivotally coupled to the handle 520 so that the blade 518 can pivot about a pivot point 522 between an extended position (FIGS. 20-25) and a retracted or closed position where the blade 518 is substantially received and stored within the handle 520 between the portions 512 and 514. The handle 520 includes an elongated recess 524 adjacent a rear end of the handle 520. The recess 524 exposes a relatively small portion of the blade 518 when the blade 518 is closed so that the blade 518 can be used to cut wire, string, and the like by placing the wire, string, etc. in the recess 524.

The frame 516 includes a locking member 528 that retains the blade 518 in the extended position. The locking member 528 is formed from a leaf spring or cantilevered spring portion 532 of the frame 516 and the locking member 528 includes an actuator 534, which is a tab portion of the frame 516. The locking member 528 is biased in the direction of arrow 536, as illustrated in FIG. 25, and retains the blade 518 in the extended positions, as will be discussed in more detail below.

Figure 23:
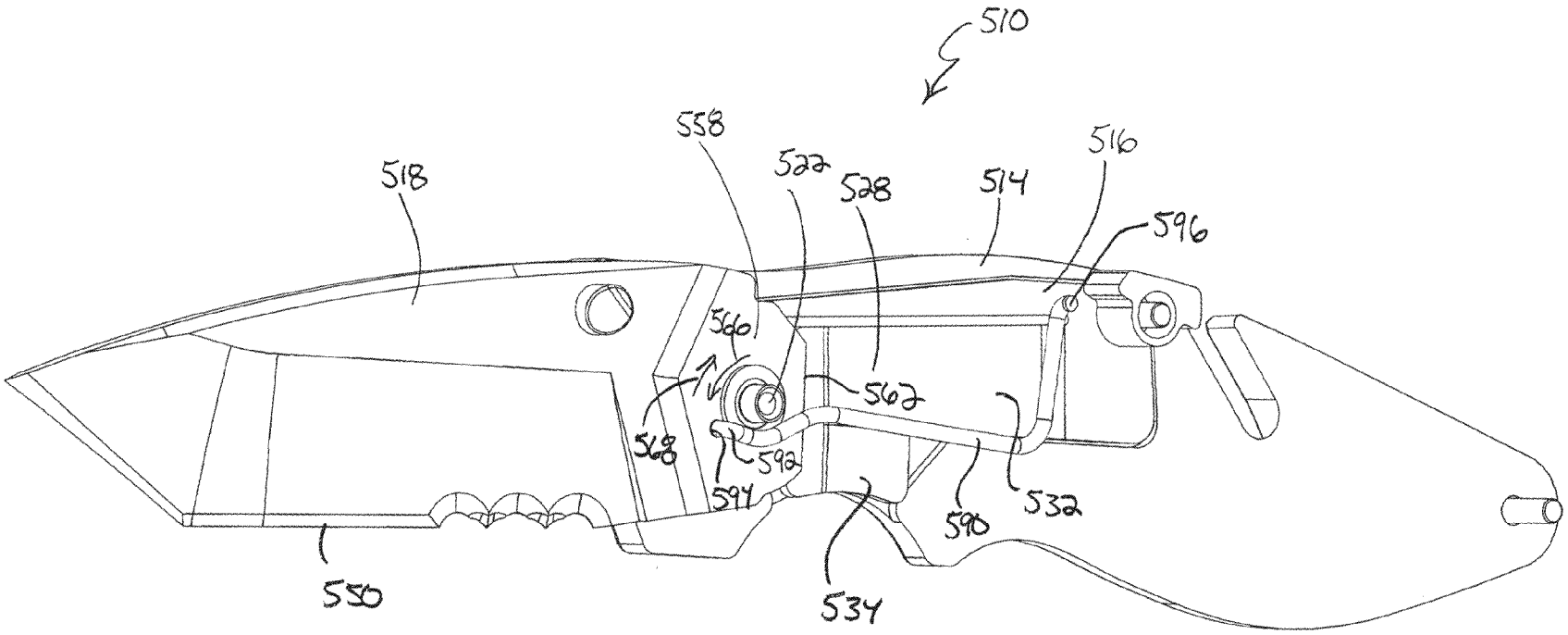
FIG. 23 is an alternative perspective view of the knife of FIG. 20 with the handle portion removed.
Figure 24:
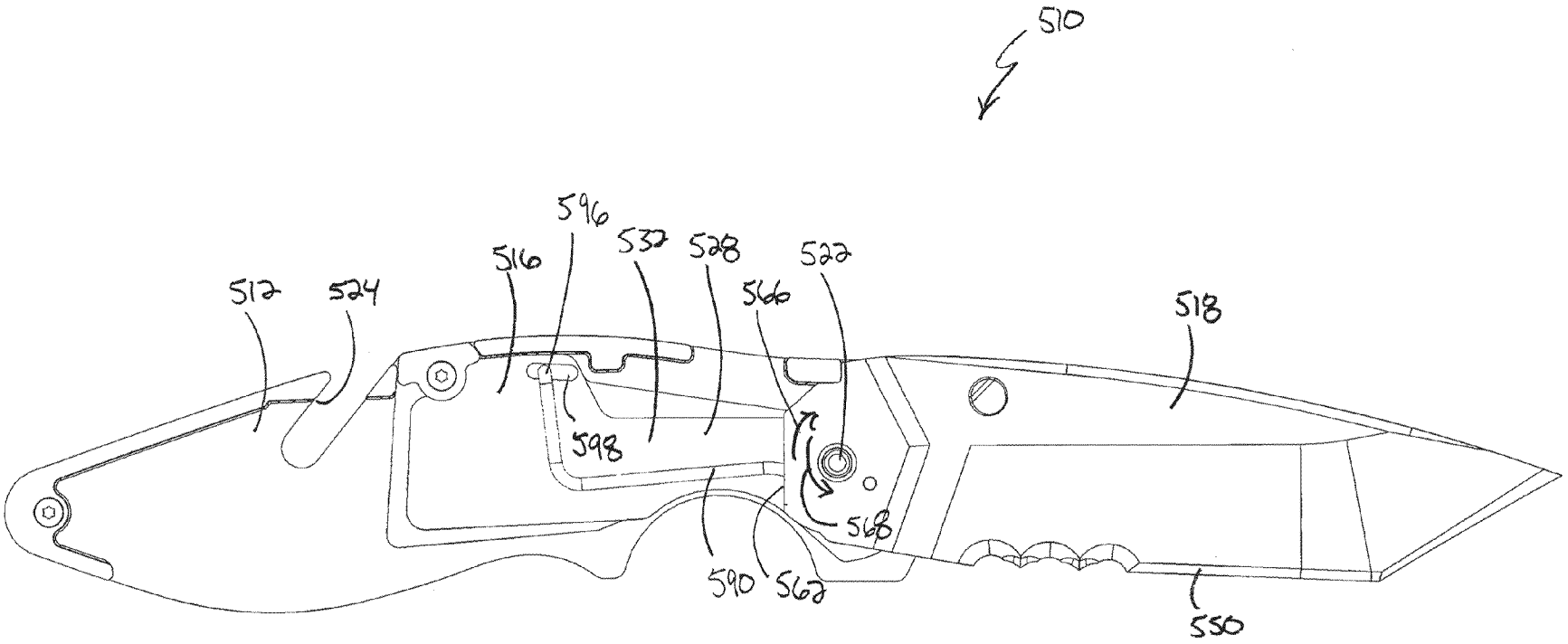
FIG. 24 is a perspective view of the knife of FIG. 20 with a handle portion removed.

The knife 510 further includes an over-center spring 590. Referring to FIGS. 23 and 24, the over-center spring 590 includes a first end portion 592 received in an aperture 594 of the blade 518 and a second end portion 596 received in an elongated aperture 598 of the frame 516 such that the second end portion 596 has limited movement within the aperture 598 relative to the frame 516.

The illustrated knife 510 includes the blade 518, which is similar to the blade 418 described above with respect to the knife 410. However, in other embodiments, the knife 510 can include any of the blades 18, 118, 218, or 318 described above. The blade 518 is pivotally coupled to the frame 516 and the handle 520 adjacent a rear end portion 558 of the blade 518. The rear end portion 558 of the blade 518 includes a generally flat portion 562.

Figure 25:
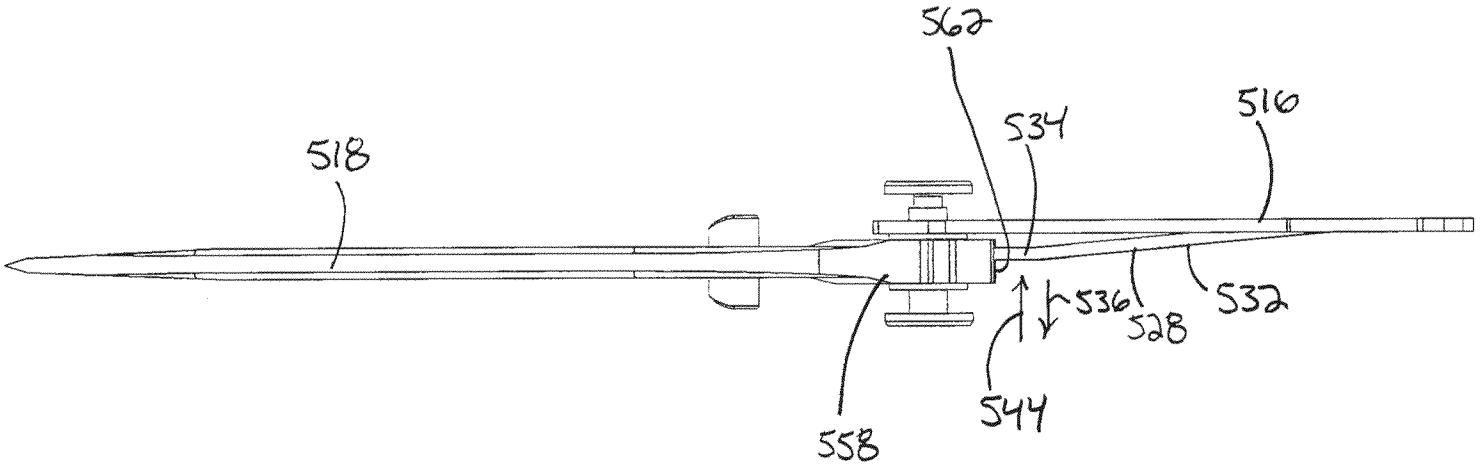
FIG. 25 is a top view of the knife of FIG. 20 with the handle portions removed.

In operation, to pivot the blade 518 between the extended position (FIGS. 20-25) and the retracted or closed position where the blade 518 is received within the handle 520, the user pushes the tab 534 of the locking member 528 in the direction of arrow 544 of FIG. 25 against the bias of the spring portion 532. The user pushes the tab 534 in the direction of arrow 544 to push the locking member 528 out of engagement with the flat portion 562 of the blade 518. Engagement between the flat portion 562 of the blade 518 and the locking member 528 retains the blade 518 in the extended position. With the flat portion 562 no longer engaged with the locking member 528, the user can pivot the blade 518 about the pivot point 522 in the direction of arrow 566 to the closed position. When the blade 518 is pivoted about half-way to the closed position from the extended position, the over-center spring 590 biases the blade 518 in the direction of arrow 566 about the pivot 522 toward the closed position to move the blade 518 to the closed position and retain the blade 518 in the closed position.

To move the blade 518 back to the extended position, the user pivots the blade 518 about the pivot point 522 in the direction of arrow 568 toward the extended or open position. When the blade 518 is about half-way between the extended position and the retracted position, the over-center spring biases the blade 518 in the direction of arrow 568 about the pivot 522 to move the blade 518 to the fully extended position. When the blade 518 reaches the fully extended position, the spring portion 532 of the locking member 528 causes first locking member 528 to automatically move in the direction of arrow 536 until the locking member 528 engages the flat portion 562 of the blade 518 and complimentary flat portions of the blade 518 and locking member 528 hold the blade 518 in the extended position.

Figure 26:
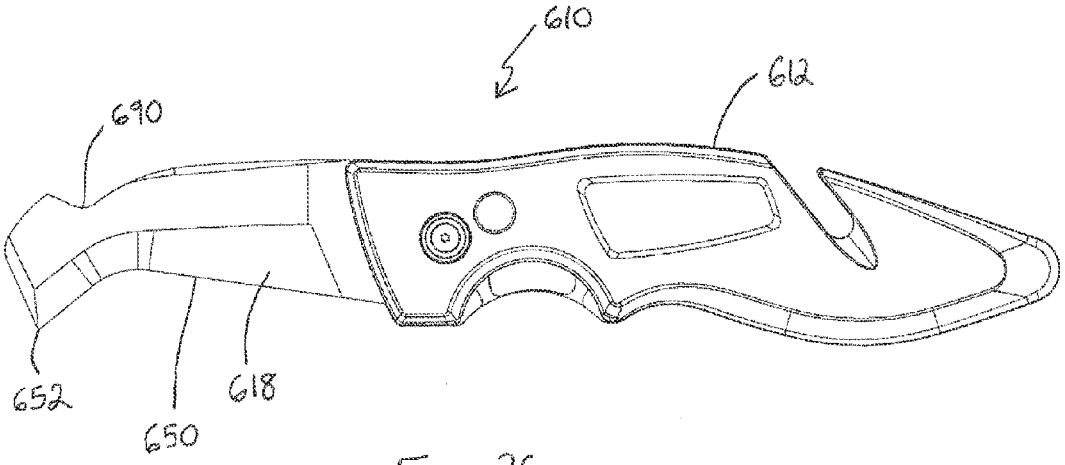
FIG. 26 is a side view of a knife according to another embodiment.

FIG. 26 illustrates a knife 610 according to another embodiment. The knife 610 includes features similar to the knife 10 described above and only differences between the knives 10 and 610 will be discussed in detail below and like components have been given like reference numbers plus 600. The illustrated knife 610 includes the blade 618, which is particularly suited for use by an electrician. The blade 618 includes a sharp cutting edge 650 that extends along a bottom edge of the blade 618, which can be used to cut any suitable material. A point 652 is located near a front end of the blade 618. The point 652 can be used to splice Romex® non-metallic building wire or cut and remove the outer insulation from such a wire. A top edge of the blade 618 includes a recess 690 near the front end of the blade. During operation, the user can place their finger, for example their index finger, in the recess 690 to help control the blade 618 when the user is using the blade 618 to pierce, strip, or cut wire.

Various features and advantages of the invention are set forth in the following claims.

What is claimed is:

1. A knife comprising:

a handle;

a blade including a cutting edge and pivotally coupled to the handle so that the blade can pivot about a pivot point relative to the handle between an extended position and a retracted position, in the retracted position the blade is substantially received within the handle and in the extended position the cutting edge is exposed; and a frame at least partially within the handle, the frame including a first locking member and a second locking member, the first locking member is at least partially formed from a leaf spring portion of the frame, the second locking member is at least partially formed from a second leaf spring portion of the frame, wherein the second locking member engages the blade to retain the blade in the retracted position and the second locking member is movable out of engagement with the blade to allow the pivotal movement of the blade from the retracted position to the extended position, and wherein the first locking member engages the blade to retain the blade in the extended position and the first locking member is movable out of engagement with the blade to allow the pivotal movement of the blade from the extended position to the retracted position, wherein the knife further includes a push button that is movable relative to the handle, the push button operable to move the second locking member out of engagement with the blade to allow the pivotal movement of the blade from the retracted position to the extended position.

2. The knife of claim 1, wherein the cutting edge extends along a bottom edge of the blade, the blade further including a point adjacent a front end of the blade, and a hook located at a top edge of the blade.

3. The knife of claim 1, wherein the cutting edge extends along a bottom edge of the blade, the blade further including a plurality of arcuate recesses that open toward a top edge of the blade.

4. The knife of claim 1, wherein the blade includes a plurality of apertures that extend through the blade and each of the plurality of apertures includes an arcuate cutting edge.

5. The knife of claim 1, wherein the cutting edge extends along a bottom edge of the blade, the blade further including a sharp projection that extends down from a generally flat portion of the blade that is not sharp.

6. The knife of claim 5, wherein the handle includes a semi-circular recess such that the cutting edge can be used to cut a tube located in the semi-circular recess when the blade is positioned between the extended position and the refracted position.

7. A knife comprising:

a first handle portion;

a second handle portion;

a blade including a cutting edge, a front end portion, and a rear end portion, the rear end portion including a generally flat portion, a locking aperture, and the rear end portion pivotally coupled to the first and second handle portions so that the blade can pivot about a pivot point relative to the first and second handle portions between an extended position and a retracted position, in the retracted position the blade is substantially received between the first and second handle portions and in the extended position the cutting edge is exposed; and a frame between the first and second handle portions, the frame including a first locking member and a second locking member, the first locking member is at least partially formed from a leaf spring portion of the frame and the first locking member includes a first actuator that is a tab portion of the frame, the second locking member is at least partially formed from a second leaf spring portion of the frame, the second locking member further includes a projection and a second actuator that includes a push button to move the projection against the bias of the second leaf spring portion, wherein the projection of the second locking member is received in the locking aperture of the blade to retain the blade in the retracted position and the projection is movable out of the locking aperture via the push button to allow the pivotal movement of the blade from the refracted position to the extended position, and wherein the first locking member engages the generally flat portion of the blade to retain the blade in the extended position and the first locking member is movable out of engagement with the generally flat portion of the blade via the tab to allow the pivotal movement of the blade from the extended position to the retracted position.

8. The knife of claim 7, wherein the cutting edge extends along a bottom edge of the blade, wherein the blade further includes a point adjacent a front end of the blade and a hook located at a top edge of the blade.

9. The knife of claim 7, wherein the cutting edge extends along a bottom edge of the blade, wherein the blade further includes a plurality of arcuate recesses that open toward a top edge of the blade.

10. The knife of claim 7, wherein the cutting edge extends along a bottom edge of the blade, the blade further including a plurality of arcuate recesses that open toward a top edge of the blade.

11. The knife of claim 7, wherein the blade includes a plurality of apertures that extend through the blade and each of the plurality of apertures includes an arcuate cutting edge.

12. The knife of claim 7, wherein the cutting edge that extends along a bottom edge of the blade, and wherein the blade further includes a sharp projection that extends down from a generally flat portion of the blade that is not sharp.

13. The knife of claim 12, wherein the first and second handle portions each include a semi-circular recess such that the cutting edge can be used to cut a tube located in the semi-circular recess when the blade is positioned between the extended position and the refracted position.

* * * * *